US008513938B2

(12) United States Patent
Tachibana et al.

(10) Patent No.: US 8,513,938 B2
(45) Date of Patent: Aug. 20, 2013

(54) REFERENCE VOLTAGE CIRCUIT AND SEMICONDUCTOR INTEGRATED CIRCUIT

(75) Inventors: Suguru Tachibana, Yokohama (JP); Hiroyuki Matsunami, Yokohama (JP); Yukinobu Tanida, Yokohama (JP)

(73) Assignee: Fujitsu Semiconductor Limited, Yokohama (JP)

( * ) Notice: Subject to any disclaimer, the term of this patent is extended or adjusted under 35 U.S.C. 154(b) by 107 days.

(21) Appl. No.: 13/316,522

(22) Filed: Dec. 11, 2011

(65) Prior Publication Data

US 2012/0212194 A1 Aug. 23, 2012

(30) Foreign Application Priority Data

Feb. 23, 2011 (JP) ..... 2011-036712

(51) Int. Cl.
*G05F 3/16* (2006.01)
*G05F 3/20* (2006.01)

(52) U.S. Cl.
USPC ..... 323/315; 323/314; 323/316; 327/538; 327/539; 327/540; 330/253; 330/258

(58) Field of Classification Search
USPC ..... 323/314, 315, 316; 327/538, 539, 327/540; 330/253, 258
See application file for complete search history.

(56) References Cited

U.S. PATENT DOCUMENTS

| | | | | |
|---|---|---|---|---|
| 4,884,039 | A * | 11/1989 | King et al. | 330/253 |
| 5,325,045 | A | 6/1994 | Sundby | |
| 6,664,773 | B1 * | 12/2003 | Cunnac et al. | 323/277 |
| 6,812,684 | B1 | 11/2004 | Leifhelm et al. | |
| 7,696,793 | B2 * | 4/2010 | Sunairi | 327/108 |
| 7,733,179 | B2 * | 6/2010 | Forejt | 330/258 |
| 2002/0089860 | A1 * | 7/2002 | Kashima et al. | 363/13 |
| 2002/0163379 | A1 * | 11/2002 | Kimura | 327/540 |
| 2003/0102851 | A1 * | 6/2003 | Stanescu et al. | 323/280 |
| 2003/0218454 | A1 * | 11/2003 | Cunnac et al. | 323/316 |
| 2005/0127987 | A1 | 6/2005 | Sato et al. | |
| 2005/0134365 | A1 * | 6/2005 | Kimura | 327/543 |
| 2007/0279105 | A1 * | 12/2007 | Sunairi | 327/108 |

FOREIGN PATENT DOCUMENTS

| | | |
|---|---|---|
| JP | H08-018353 A | 1/1996 |
| JP | 2004-514230 | 5/2004 |
| JP | 2005-182113 A | 7/2005 |

* cited by examiner

*Primary Examiner* — Bao Q Vu
(74) *Attorney, Agent, or Firm* — Fujitsu Patent Center

(57) ABSTRACT

A reference voltage circuit includes a first amplifier, a first load device and a first PN junction device, second and third load devices and a second PN junction device, an offset voltage reduction circuit, a coupling node potential takeout circuit, and an area adjustment circuit. The offset voltage reduction circuit is configured to reduce an offset voltage between the first and second input terminals at the first amplifier, and the coupling node potential takeout circuit is configured to take out potentials of the first and second coupling nodes. The area adjustment circuit is configured to adjust an area of the second PN junction device in accordance with the potentials of the first and second coupling nodes which are taken out by the coupling node potential takeout circuit.

15 Claims, 22 Drawing Sheets

REFERENCE VOLTAGE CIRCUIT AND SEMICONDUCTOR INTEGRATED CIRCUIT

CROSS-REFERENCE TO RELATED APPLICATION

This application is based upon and claims the benefit of priority of the prior Japanese Patent Application No. 2011-036712, filed on Feb. 23, 2011, the entire contents of which are incorporated herein by reference.

FIELD

The embodiments discussed herein are related to a reference voltage circuit and a semiconductor integrated circuit.

BACKGROUND

In analog integrated circuits, when a reference voltage not dependent on the temperature and power source voltage was used, a reference voltage circuit called a "bandgap circuit" was used. Mounting together with digital circuits is easy, so even in important CMOS analog integrated circuits, bandgap circuits are being widely used as stable reference voltage circuits.

In a related bandgap circuit, the potential of a forward-biased PN junction and a voltage proportional to the absolute temperature (T) (in general, called PTAT) are added to obtain a reference voltage not dependent on the temperature. Various types of such circuits are provided.

It is known that, if approximating the potential of the PN junction by a linear equation or within the range able to be approximated by a linear equation, the potential of the forward-biased PN junction is the complementary-to-absolute temperature (CTAT). Further, it is known that by adding a suitable PTAT voltage to the potential of this forward-biased PN junction, a reference voltage substantially not dependent on temperature is obtained.

Incidentally, in the past, various techniques are proposed for adjusting the value of the VBGR.

Patent Document 1: Japanese National Publication of International Patent Application No. 2004-514230

Patent Document 2: Japanese Laid-open Patent Publication No. H08-018353

Patent Document 3: Japanese Laid-open Patent Publication No. 2005-182113

Patent Document 4 U.S. Pat. No. 5,325,045

SUMMARY

According to an aspect of the embodiment, a reference voltage circuit includes a first amplifier, a first load device and a first PN junction device, second and third load devices and a second PN junction device, an offset voltage reduction circuit, a coupling node potential takeout circuit, and an area adjustment circuit.

The first amplifier included first and second input terminals, which is coupled to a first power source line and a second power source line, and is configured to output a reference voltage. The first load device and the first PN junction device are coupled in series between a reference voltage line to which the reference voltage is applied and the second power source line.

The second and third load devices and the second PN junction device are coupled in series between the reference voltage line and the second power source line. The first input terminal is coupled to a first coupling node which connects the first load device and the first PN junction device, and the second input terminal is coupled to a second coupling node which connects the second load device and the third load device.

The offset voltage reduction circuit is configured to reduce an offset voltage between the first and second input terminals at the first amplifier, and the coupling node potential takeout circuit is configured to take out potentials of the first and second coupling nodes. The area adjustment circuit is configured to adjust an area of the second PN junction device in accordance with the potentials of the first and second coupling nodes which are taken out by the coupling node potential takeout circuit.

The object and advantages of the embodiments will be realized and attained by the elements and combinations particularly pointed out in the claims.

It is to be understood that both the foregoing general description and the following detailed description are exemplary and explanatory and are not restrictive of the embodiments, as claimed.

DESCRIPTION OF EMBODIMENTS

Before describing in detail the embodiments of a reference voltage circuit and a semiconductor integrated circuit, examples of a bandgap circuit (reference voltage circuit) will be described with reference to FIG. 1 to FIG. 6.

Figure 1:
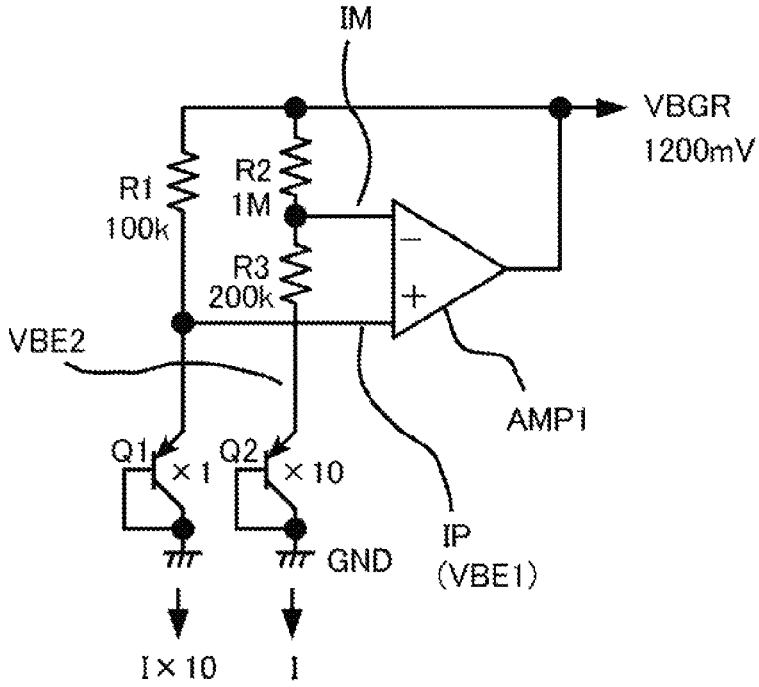
FIG. 1 is a circuit diagram illustrating a first example of a related bandgap circuit.

In FIG. 1, reference notations Q1 and Q2 indicate PNP bipolar transistors (below, also described as pnpBJT), while R1, R2, and R3 indicate resistors. Note that, the resistance values of the resistors R1, R2, and R3 are also indicated by R1, R2, and R3. Below, similarly, Rn (where n is an integer) indicates a resistor and also illustrates the resistance value of the same.

Furthermore, reference notation AMP1 indicates an operating amplifier circuit (CMOS operating amplifier), GND indicates a GND terminal (first power source line: 0V), while VBGR indicates an output reference potential (reference voltage). Further, reference notations VBE2, IM, and IP indicate internal nodes.

In FIG. 1, the values attached to the resistors (for example, 100 k and 200 k) indicate examples of the resistance values, while the numerals attached to BJT (for example, x1, x10) indicate the relative ratios of areas of BJT. In the same way, in the other figures as well, the numerals attached to BJT indicate the relative ratios of areas of the BJT.

Furthermore, in FIG. 1, VBE2, at the same time as being the name of the node, also indicates the base-emitter voltage of the transistor Q2. Further, the potential of the node IP is equal to the base-emitter voltage of the transistor Q1, so the potential is expressed by VBE1.

The operation of the bandgap circuit illustrated in FIG. 1 will be simply explained. If expressing the base-emitter voltage of BJT, that is, the forward direction voltage of the PN junction, by VBE, it is known that the relationship of the forward direction voltage of the PN junction and the absolute temperature T becomes generally the following formula (1):

$$VBE=Veg-aT \quad \text{formula (1)}$$

Here, VBE indicates the forward direction voltage of the PN junction, Veg indicates the bandgap voltage of silicon (about 1.2V), a indicates the temperature dependency of VBE (about 2 mV/° C.), and T indicates the absolute temperature. Note that, the value of a differs based on the bias current, but in the practical region is known to be about 2 mV/° C. or so.

Further, it is known that the relationship between the emitter current IE and the voltage VBE of BJT generally becomes the following formula (2):

$$IE=I0\exp(qVBE/kT) \quad \text{formula (2)}$$

Here, IE indicates the emitter current of the BJT or the current of the diode, I0 indicates a constant (proportional to the area), q indicates a charge of electrons, and, further, k indicates Boltzmann's constant. When, due to the negative feedback by the operating amplifier AMP1, the voltage gain of the AMP1 is sufficiently large, the potentials of the first input IP and second input IM of the AMP1 become (substantially) equal and the circuit stabilizes.

At this time, as illustrated in FIG. 1, if designing the resistance values of the resistors R1 and R2 to, for example, 1:10 (100 k:1 M), the magnitudes of the currents flowing through the transistors Q1 and Q2 become 10:1.

Here, the current flowing through the transistor Q1 is expressed by 10I, while the current flowing through the transistor Q2 is expressed by I. Note that, in FIG. 1, the I×10 and the I attached below Q1 and Q2 illustrate the correspondence of this current. Similarly, in the other drawings as well, the I×10 and I etc. attached to BJT indicate the correspondence of the flowing currents.

Assume that the emitter area of the transistor Q2 is 10 times the emitter area of the transistor Q1. Note that, the x1 and x10 attached to the transistors Q1 and Q2 of FIG. 1 illustrate the correspondence of the emitter areas.

Further, if expressing the base-emitter voltage of the transistor Q1 by VBE1 and expressing the base-emitter voltage of the transistor Q2 by VBE2, it is learned, from the formula (2), that there are the relationships of the following formula (3) and formula (4):

$$10\times I=I0\exp(qVBE1/kT) \quad \text{formula (3)}$$

$$I=10\times I0\exp(qVBE2/kT) \quad \text{formula (4)}$$

If calculating the two sides and expressing the result by VBE1-VBE2=ΔVBE, the following formula (5) and formula (6) are obtained:

$$100=\exp(qVBE1/kT-qVBE2/kT) \quad \text{formula (5)}$$

$$\Delta VBE=(kT/q)ln(100) \quad \text{formula (6)}$$

That is, the difference ΔVBE of the base-emitter voltage of the transistors Q1 and Q2 is expressed by the log of the current density ratio 100 of the transistors Q1 and Q2 (ln(100)) and thermal voltage (kT/q). This ΔVBE is equal to the potential difference across the two ends of the resistor R3, so the resistors R2 and R3 include a current of ΔVBE/R3 flowing through them.

Therefore, the potential difference VR2 of the two ends of the resistor R2 is expressed by the following formula (7):

$$VR2=\Delta VBE(R2/R3) \quad \text{formula (7)}$$

Further, the potential of IP and the potential of IM are equal at VBE1, so the potential of the reference voltage VBGR is expressed by the following formula (8):

$$VBGR=VBE1+\Delta VBE(R2/R3) \quad \text{formula (8)}$$

The forward direction voltage VBE1 includes a negative temperature dependency where it falls along with a rise of the temperature (VBE=Veg-aT formula (1)), while ΔVBE, as illustrated in formula (6), increases in proportion to the temperature.

Therefore, by suitably selecting the constants, it is possible to design the circuit so that the value of the reference voltage VBGR is not dependent on temperature. The value of VBGR at this time becomes about 1.2V (1200 mV) corresponding to the bandgap voltage of silicon.

In this way, in the bandgap circuit of FIG. 1, by suitably selecting the circuit constants, it is possible to generate a bandgap voltage not dependent on temperature by a relative simple circuit.

Figure 2:
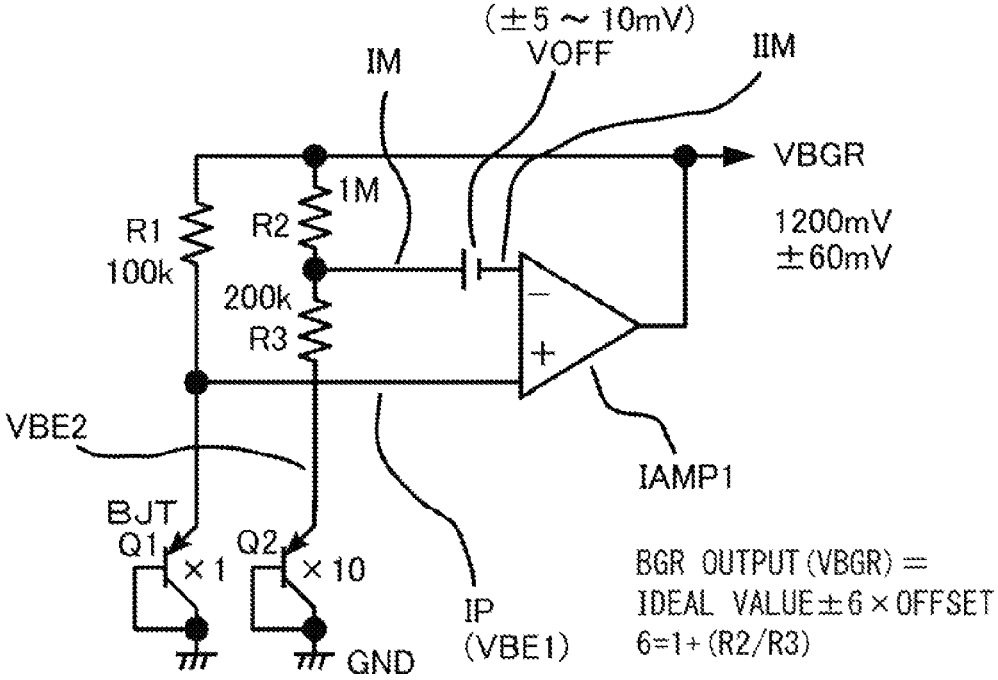
FIG. 2 is a view for explaining points for improvement in the bandgap circuit of FIG. 1.

However, the bandgap circuit of this FIG. 1 also includes points for improvement as explained next. FIG. 2 is a view for explaining the points for improvement in the bandgap circuit of FIG. 1.

In FIG. 2, reference notations Q1 and Q2 indicate PNP bipolar transistors (pnpBJT), while R1, R2, and R3 indicate resistors. Note that, the resistance values of the resistors R1, R2, and R3 are indicated by R1, R2, and R3.

Reference notation IAMP1 indicates an ideal operating amplifier circuit, GND indicates a GND terminal, VBGR indicates an output reference potential, and, further, IM and IP indicate internal nodes. Furthermore, VOFF indicates an equivalent voltage source expressing the offset voltage of the operating amplifier, while IIM indicates a minus-side input terminal of the ideal operating amplifier IAMP1.

Note that the values attached to the resistors indicate examples of resistance values, while values attached to the BJT indicate relative ratios of areas of the BJT. Note that, unless otherwise specified, corresponding devices and nodes in the figures are assigned the same names and overlapping explanations are avoided.

To explain the problems in the bandgap circuit of FIG. 1, in FIG. 2, the AMP1 of FIG. 1 is illustrated by the ideal operating amplifier IAMP1 and equivalent offset voltage VOFF. The basic operation is similar to that explained in FIG. 1, so, in FIG. 2, it is explained what kind of effect the offset voltage VOFF includes on the reference voltage VBGR.

At the CMOS circuit, when forming a bandgap circuit (reference voltage circuit), in particular a circuit such as illustrated in FIG. 1, it is not possible to avoid the effect of the offset voltage of the operating amplifier. Ideally, when the input potentials IM and IP of the AMP1 of FIG. 1 are equal, the output potential of the AMP1 becomes, for example, a potential of about ½ of the power source voltage.

However, in an actual integrated circuit (LSI), the characteristics of the devices making up the amplifiers will never completely match, so whether the output potential of the AMP1 becomes, for example, a potential of about ½ of the power source voltage differs depending on the individual amplifiers. Further, the differential potential of the input potential at this time is called the offset voltage (VOFF). It is known that the typical offset voltage is, for example, about ±10 mV.

To explain what kind of effects the actual characteristics of an amplifier include on the output potential of the bandgap circuit, in FIG. 2, the AMP1 of FIG. 1 is illustrated by the ideal operating amplifier IAMP1 and equivalent offset voltage VOFF. Note that, the offset voltage of the ideal operating amplifier IAMP1 is assumed to be 0 mV.

In the ideal circuit of FIG. 1, the potentials of the inputs IM and IP match. However, in an actual circuit, the potentials of the inputs IM and IP of the virtual ideal operating amplifier IAMP1 match, so the potentials of the IM and the IP become offset by exactly a value corresponding to the offset voltage VOFF. For simplification of the explanation, the potential difference VR3 applied across the resistor R3 in the ideal state is expressed by the following formula (9):

$$VR3=\Delta VBE \qquad \text{formula (9)}$$

The potential difference VR3' applied to the resistor R3 of FIG. 2 is generally expressed by the following formula (10). Note that, VOFF indicates the value of the offset voltage VOFF:

$$VR3'=\Delta VBE+V\mathrm{OFF} \qquad \text{formula (10)}$$

Further, the potential difference VR2' across the resistor R2 is expressed by the following formula (11):

$$VR2'=(\Delta VBE+V\mathrm{OFF})R2/R3 \qquad \text{formula (11)}$$

Therefore, the reference voltage VBGR is expressed by the following formula (12):

$$VBGR=VBE1+V\mathrm{OFF}+(\Delta VBE+V\mathrm{OFF})R2/R3 \qquad \text{formula (12)}$$

As illustrated in FIG. 2, if making R2/R3=1 M/200 k=5, the value of VBGR becomes the ideal value plus the offset voltage multiplied by (about) 6. That is, the result becomes BGRoutput=ideal value±6×offset.

The circuits of FIG. 1 and FIG. 2 illustrate the cases of reducing the effect of the offset voltage of the operating amplifier as much as possible by making the area of the transistor Q2 10 times that of the transistor Q1 and, furthermore, making the current flowing through Q1 10 times the current flowing through Q2.

Due to this, for example, the potential difference across R3, as illustrated in the following formula (13), may be made a relatively large value of 120 mV:

$$\Delta VBE=(kT/q)ln(100)=26\text{ mV}\times 4.6=120\text{ mV} \qquad \text{formula (13)}$$

That is, it is possible to keep the effect of the offset voltage VOFF relatively small. However, in this case as well, to obtain a 1200 mV bandgap voltage comprised of the about 600 mV VBE (VBE1) plus the PTAT voltage, it is preferable to increase the value of the formula (13) by 5 and add it to VBE1.

For this reason, when there is the offset voltage VOFF, the effect of the offset voltage VOFF is amplified by {1+(R2/R3)}=(1+5)=6 fold or so. This includes a large effect on the reference voltage VBGR. Note that, the formula of the VBGR output illustrated in FIG. 2 illustrates the effect of this offset voltage.

That is, the circuit of FIG. 1 includes the advantage of enabling configuration of a bandgap circuit by a relatively simple circuit configuration, but due to the offset voltage of the operating amplifier circuit (CMOS operating amplifier), there is a limit on the precision of the reference voltage VBGR which is achieved.

In the past, for the purpose of solving the problem of the offset voltage of the CMOS operating amplifier limiting the precision of the output voltage of the CMOS bandgap circuit, a circuit for trimming several output voltages (reference voltages) are proposed.

Figure 3:
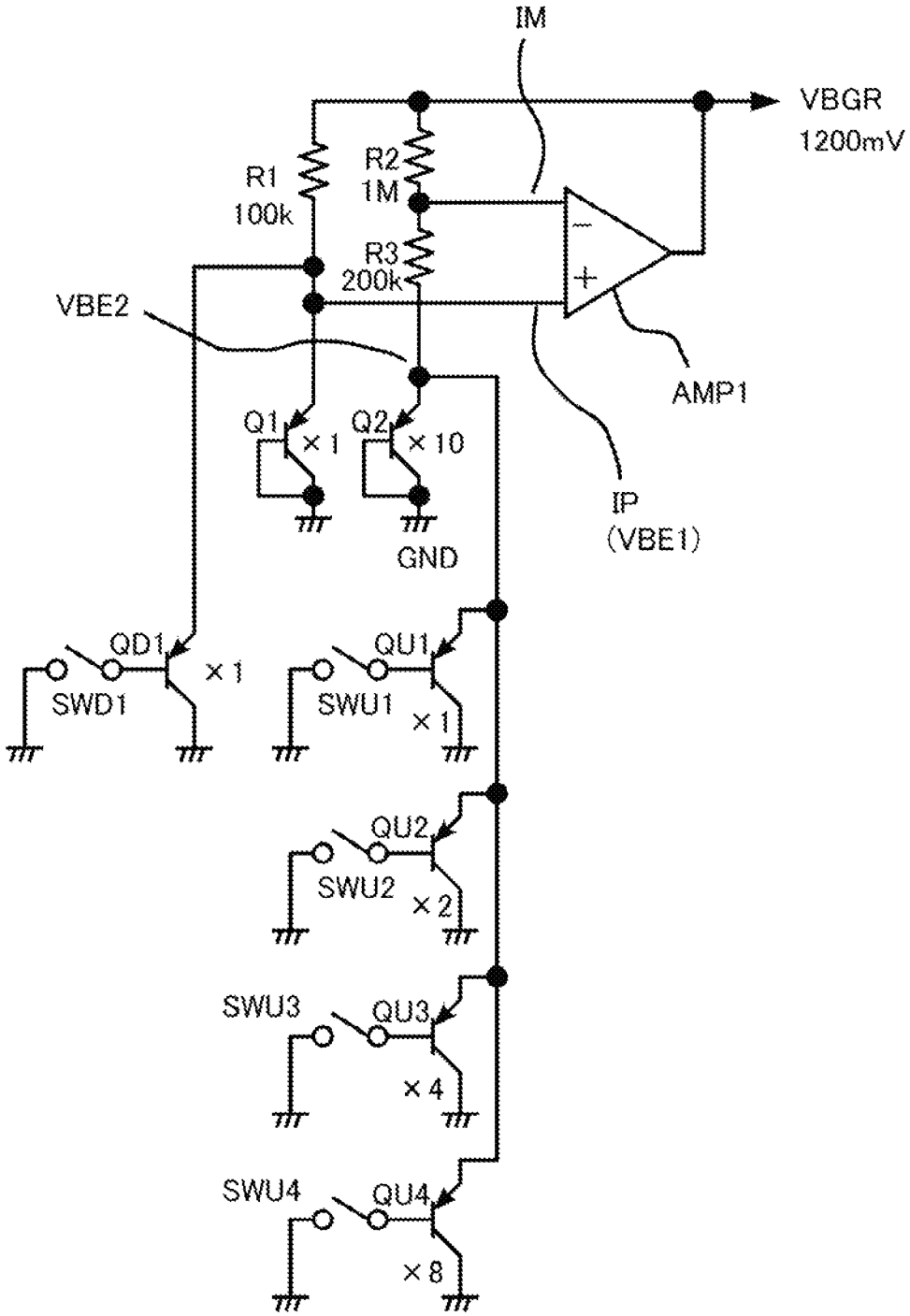
FIG. 3 is a circuit diagram illustrating a second example of a related bandgap circuit.

FIG. 3 is a circuit diagram illustrating a second example of a related bandgap circuit and illustrates application of the technique of changing the number of PNP transistors for trimming.

In FIG. 3, reference notations QD1, QU1, QU2, QU3, and QU4 indicate PNP bipolar transistors, while SWD1, SWU1, SWU2, SWU3, and SWU4 indicate switches. Note that the other notations correspond to those illustrated in FIG. 1, so explanations will be omitted.

In the circuit of FIG. 1, the input conversion offset voltage of the CMOS operating amplifier AMP1 was, for example, amplified about 6-fold and made to change the potential of the output VBGR. As factors behind fluctuation of the value of VBGR, in addition to the offset voltage of the AMP1, fluctuation of the relative values of the values of R1 to R3, fluctuation of the value of VBE1 or VBE2, etc. may be mentioned.

In the circuit of FIG. 3, for example, when the value of VBGR is smaller than the target value, the switches SWU1 to SWU4 may be turned ON so as to increase the effective area of the transistor Q2.

Specifically, if turning the switch SWU1 ON and turning the switches SWU2 to SWU4 OFF, only the transistor QU1 turns ON, while the transistors QU2 to QU4 may be turned OFF.

Due to this, the current density of the transistor Q2 becomes smaller, so the VBE difference ΔVBE of Q1 and Q2 becomes larger. Further, if ΔVBE becomes larger, the voltage which is amplified by R2/R3 and added to VBE1 becomes larger, so the potential of VBGR may be increased. This is clear from the above-mentioned formula (8) VBGR=VBE1+ΔVBE(R2/R3).

Here, for example, it is possible to binarily weight the transistors QU1 to QU4 and control the switches SWU1 to SWU4 by 4-bit digital data so as to change the increase in area of the transistor Q2 from an area the same as the transistor Q1 to a value of 15 times the Q1.

Further, for example, when the value of the VBGR in the circuit of FIG. 3 is larger than the target value, by turning the switch SWD1 ON, it is possible to increase the effective area of the transistor Q1. That is, if turning the switch SWD1 ON, the transistor QD1 turns ON.

Due to this, the current density of the transistor Q1 becomes smaller, so the VBE difference ΔVBE between Q1 and Q2 becomes smaller. Further, if ΔVBE becomes smaller, the voltage amplified by R2/R3 and added to VBE1 becomes smaller, so it is possible to reduce the potential of the VBGR.

In this way, the bandgap circuit illustrated in FIG. 3 is made variable in area ratio of the PNP transistors, so the potential of the VBGR may be adjusted.

Figure 4:
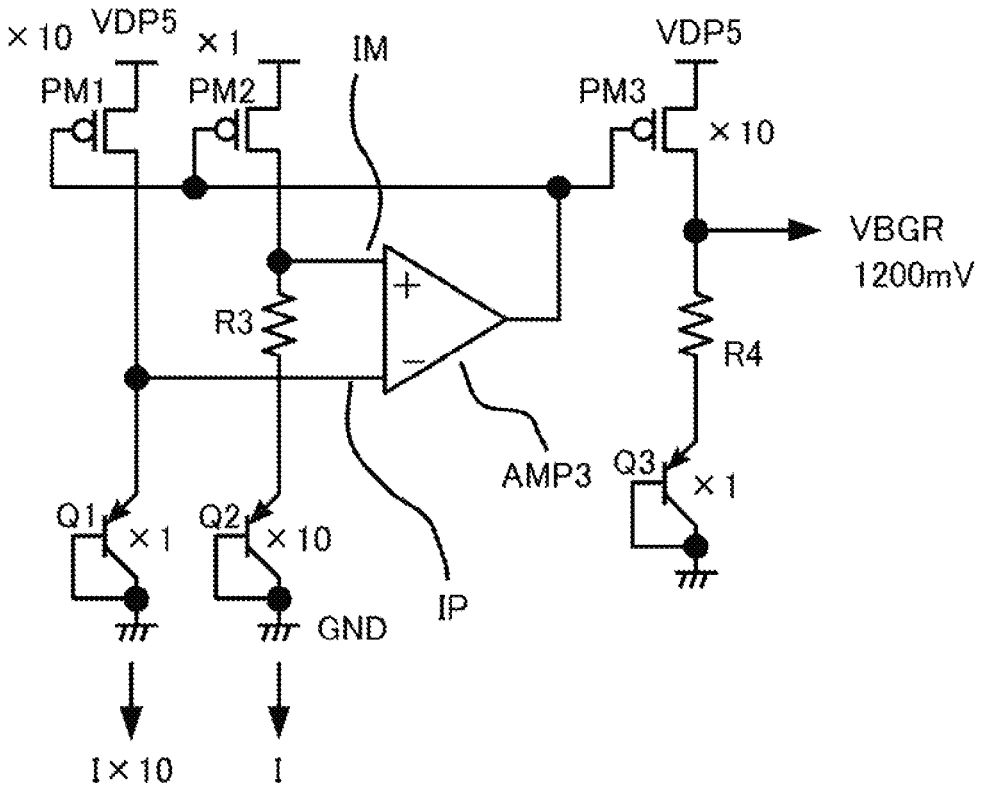
FIG. 4 is a circuit diagram illustrating a third example of a related bandgap circuit.

FIG. 4 is a circuit diagram which illustrates a third example of a related bandgap circuit. In FIG. 4, reference notations Q1, Q2, and Q3 indicate PNP bipolar transistors, R3 and R4 indicate resistors, AMP3 indicates an operating amplifier circuit, and, further, GND indicates a GND terminal (0V).

Furthermore, reference notation VDP5 indicates a 5V power source terminal, VBGR indicates an output reference potential, IM and IP indicate internal nodes, and, further, PM1, PM2, and PM3 indicate pMOS transistors. Note that, in FIG. 4, the nodes and devices corresponding to the circuit of FIG. 1 are assigned the same reference notations to enable the correspondence to be understood.

Further, in FIG. 4, the numerals (x10, x1) added to the pMOS transistors PM1, PM2, and PM3 indicate the ratios of the complementary gate widths W of the pMOS transistors. Similarly, in the other figures as well, the numerals added to the pMOS transistors indicate the ratios of the complementary gate widths W of the pMOS transistors.

Next, the operation of the bandgap circuit illustrated in FIG. 4 will be briefly explained. First, due to negative feedback by the operating amplifier AMP3, the potentials of the inputs IM and IP of the AMP3 become (almost) equal and the circuit stabilizes.

At this time, as explained with reference to FIG. 3, if setting the values of W of the transistors PM1 and PM2 to, for example, 10:1, the magnitudes of the currents flowing through the transistors Q1 and Q2 become 10:1. Here, the current flowing through the transistor Q1 is indicated by 10I, while the current flowing through the transistor Q2 is indicated by I.

Note that, the I×10 and I added below the transistors Q1 and Q2 indicate the correspondence of the currents. Similarly, in the other figures as well, the I×10 and the I etc. added to the BJT indicate the correspondence of the currents carried.

As one example, the emitter area of the transistor Q2 is made 10 times the emitter area of the transistor Q1. Note that, in FIG. 4, the x1 and x10 added to the transistors Q1 and Q2 indicate the correspondence of the emitter areas.

Furthermore, if expressing the base-emitter voltage of the transistor Q1 as VBE1 and, further, expressing the base-emitter voltage of the transistor Q2 as VBE2, it is learned that, from the above-mentioned formula (2), there are the relationships of the formula (3) and formula (4). Note that, the formula (3) to formula (6) described below are similar to those explained earlier.

$$10\times I=I0\exp(qVBE1/kT) \quad \text{formula (3)}$$

$$I=10\times I0\exp(qVBE2/kT) \quad \text{formula (4)}$$

If dividing the two sides and expressing VBE1−VBE2=ΔVBE, the formula (5) and formula (6) are obtained:

$$100=\exp(qVBE1/kT-qVBE2/kT) \quad \text{formula (5)}$$

$$\Delta VBE=(kT/q)ln(100) \quad \text{formula (6)}$$

That is, the difference ΔVBE of the base-emitter voltage of the transistors Q1 and Q2 is expressed by the log (ln(100)) of the current density ratio 100 of the transistors Q1 and Q2 and the thermal voltage (kT/q). This ΔVBE is equal to the potential difference across the resistor R3, so the resistor R3 includes the current of ΔVBE/R3 running through it.

Further, the transistors PM1, PM2, and PM3 become current mirrors, so the transistor PM1 includes a current of 10 times the transistor PM2 running through it and therefore the current flowing through the transistor PM3 and the current flowing through the transistor PM1 become equal.

Furthermore, the emitter area of the transistor Q3 and the emitter area of the transistor Q1 become equal and the currents of the transistors PM1 and PM3 become equal, so the base-emitter voltage VBE of the transistor Q1 and the VBE of the transistor Q3 become equal at VBE1.

Therefore, the potential of the reference voltage VBGR is expressed by the next formula (14):

$$VBGR=VBE1+\Delta VBE(10\times R4/R3) \quad \text{formula (14)}$$

In this way, in the bandgap circuit of FIG. 4 as well, by suitably selecting the circuit constants, it is possible to generate a bandgap voltage (reference voltage) not dependent on the temperature.

Figure 5:
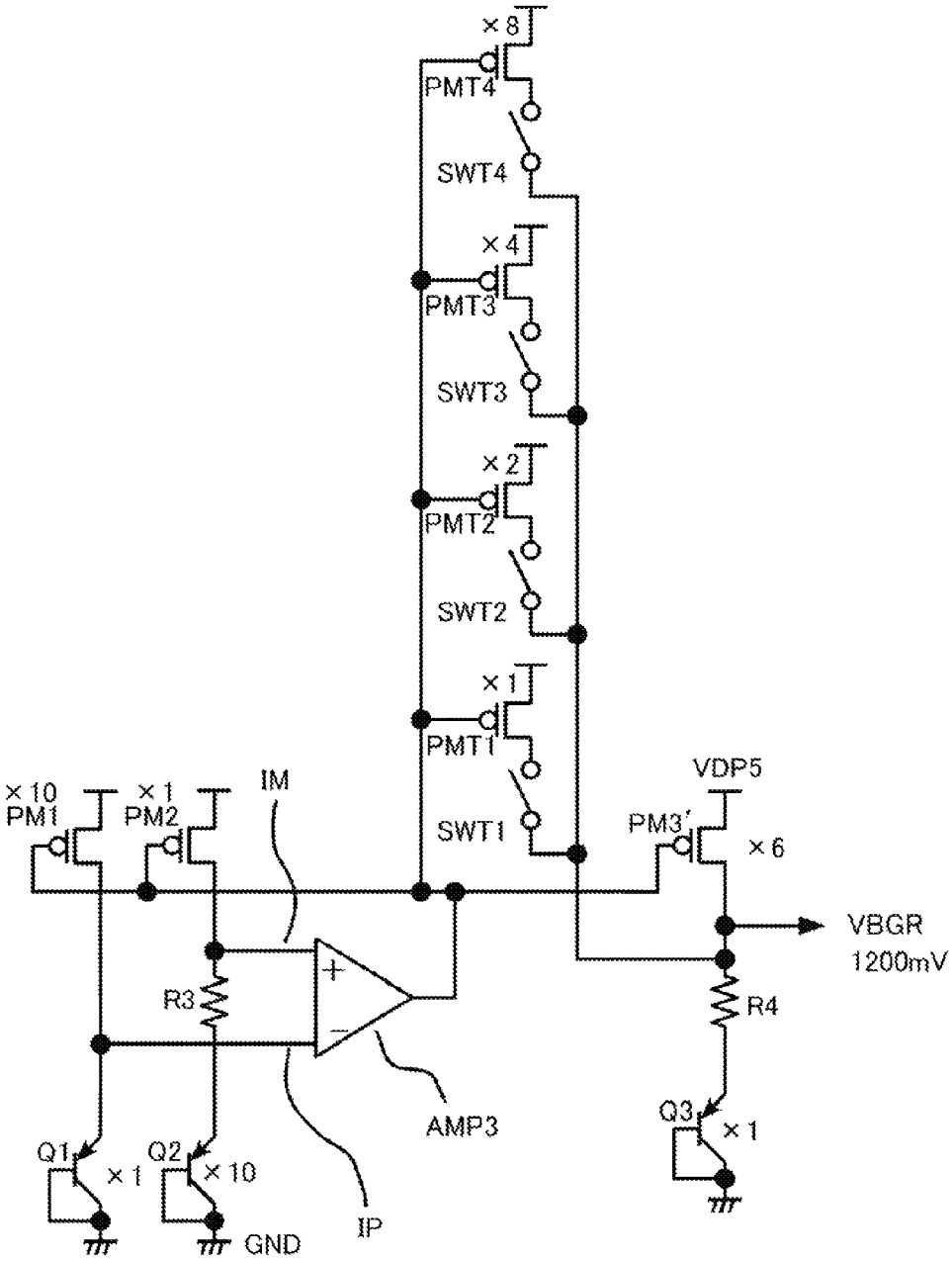
FIG. 5 is a circuit diagram illustrating a fourth example of a related bandgap circuit.

FIG. 5 is a circuit diagram illustrating a fourth example of a related bandgap circuit and illustrates the application of changing the current mirror ratio for trimming.

In FIG. 5, the reference notations Q1, Q2, and Q3 indicate PNP bipolar transistors, R3 and R4 indicate resistors, AMP3 indicates an operating amplifier circuit, GND indicates a GND terminal (0V), and, further, VDP5, for example, indicates a 5V power source terminal.

Further, reference notation VBGR indicates the output reference potential, IM and IP indicate internal nodes, PM1, PM2, PM3', and PMT1 to PMT4 indicate p-channel type MOS transistors (pMOS transistors), and, further, SWT1 to SWT4 indicate switches. Note that, in FIG. 5, nodes and devices corresponding to the circuit of FIG. 4 are assigned the same reference notations to clarify the correspondence.

Further, in FIG. 5, the numerals (x10, x1, x6, etc.) attached to the pMOS transistors PM1, PM2, PM3', and PMT1 to PMT4 indicate the relative ratios of gate widths W of the pMOS transistors. Similarly, in the other figures as well, the numerals attached to the pMOS transistors indicate the relative ratios of gate widths W of the pMOS transistors.

The differences between the bandgap circuit of FIG. 5 and the bandgap circuit of FIG. 4 lie in the addition of the transistors PMT1 to PMT4 and switches SWT1 to SWT4 and the change of the gate width W of the transistor PM3' from the x10 of FIG. 4 to x6.

Therefore, first, the differences in the circuits of FIG. 4 and FIG. 5 will be explained, then the fact that the potential of the reference voltage VBGR may be adjusted using the switches SWT1 to SWT4 by the configuration of FIG. 5 will be explained.

In the bandgap circuit of FIG. 4, making the gate width W x10 so that the current of the transistor PM3 becomes equal to the current of the transistor PM1 will be explained.

Even in the bandgap circuit of FIG. 5, when the currents flowing through the transistor Q3 and resistor R4 ideally become equal to the current of the transistor PM1, it is assumed that the potential of the VBGR becomes 1200 mV.

In the bandgap circuit of FIG. 5, the transistor PM3' includes a gate width W corresponding to x6. By selectively turning ON the transistors PMT1 to PMT4, the gate width W is adjusted to correspond to x10.

The transistors PMT1 to PMT4 are binarily weighted. By selectively turning the switches SWT1 to SWT4 ON, it is possible to realize a gate width W corresponding to x1 to corresponding to x15. By adding the gate width W of the constantly ON transistor PM3', it is possible to increase or decrease the current flowing through the transistor Q3.

When the potential of the reference voltage VBGR is lower than the target value, the gate width W turned on by the switches SWT1 to SWT4 is increased. On the other hand, when the potential of the reference voltage VBGR is higher than the target value, the gates width W turned ON by the switches SWT1 to SWT4 is decreased. Due to this, it is possible to adjust the reference output potential (reference voltage) of the bandgap circuit.

Figure 6:
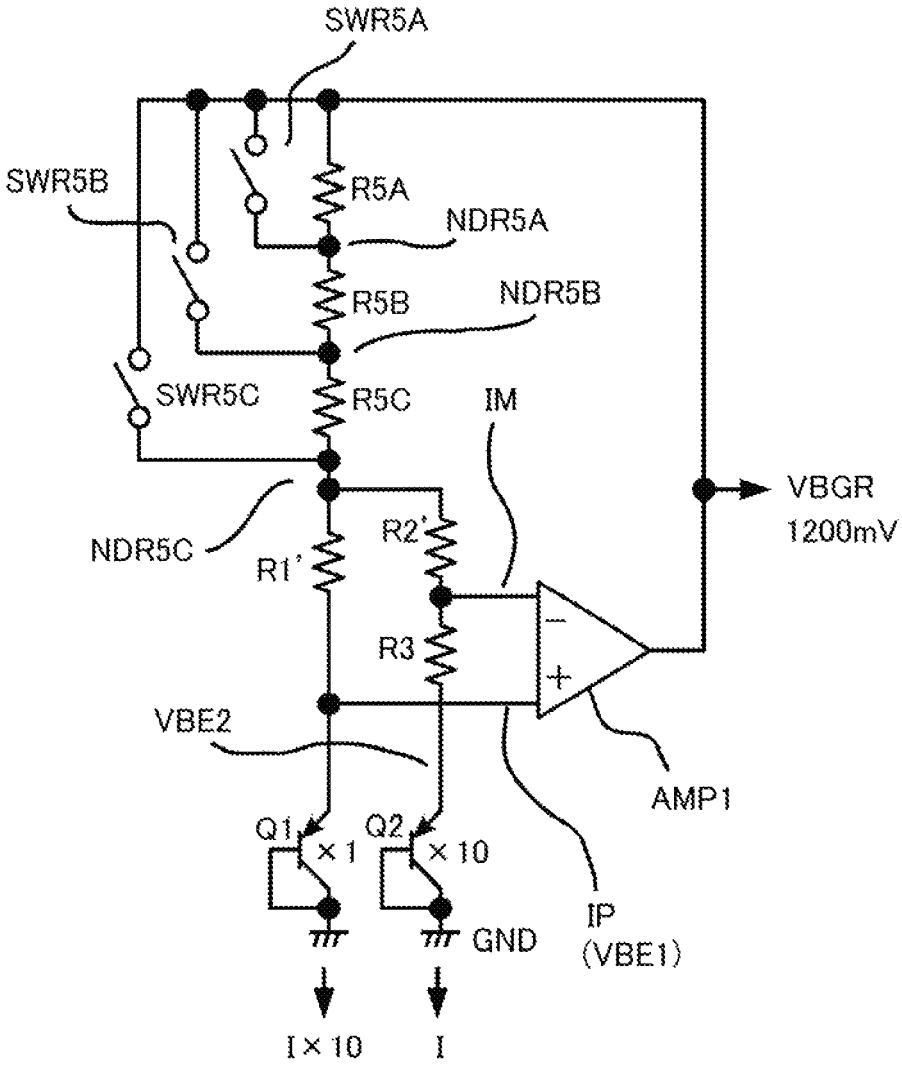
FIG. 6 is a circuit diagram illustrating a fifth example of a related bandgap circuit.

FIG. 6 is a circuit diagram illustrating a fifth example of a related bandgap circuit. The bandgap circuit of FIG. 6 is the same as the circuit of FIG. 1 in terms of the operation of the circuit, so the points of difference of the circuit of FIG. 6 from the circuit of FIG. 1 will be explained.

Furthermore, in the bandgap circuit of FIG. 6, it was explained that the action of the different circuit elements may be used to adjust the potential of the bandgap circuit output (reference voltage) VBGR. Note that, in FIG. 6, the nodes and devices corresponding to the circuit of FIG. 1 are assigned the same notations to facilitate understanding of the correspondence. Further, overlapping explanations will be omitted.

In FIG. 6, reference notations R1', R2', and R3' illustrate resistors which act substantially in the same way as the R1, R2, and R3 of FIG. 1. Note that, in FIG. 6, the resistors R5A, R5B, and R5C are added to FIG. 1, so the resistance values of the resistors R1, R2, and R3 may be changed.

For this reason, in FIG. 6, the resistors corresponding to the resistors R1 to R3 are indicated as R1', R2', and R3'. Further, in the circuit of FIG. 6, the switches SWR5A, SWR5B, and SWR5C are added to the circuit of FIG. 1.

When the switches SWR5A to SWR5C are all OFF, the resistance between the node NDR5C and VBGR becomes the total resistance of R5A, R5B, and R5C. Further, by turning any one of the switches SWR5A to SWR5C ON or turning all of them OFF, the resistance between the node NDR5C and the VBGR may be selected from the total resistance of R5A to R5C, the total resistance of R5B and R5C, the resistance of R5C, and zero.

That is, the bandgap circuit of FIG. 6 enables adjustment of the resistance between the node NDR5C and the VBGR by the switches SWR5A, SWR5B, and SWR5C and the resistors R5A, R5B, and R5C.

That is, when the potential of the VBGR is higher than a target value, it is possible to reduce the resistance between the node NDR5C and the VBGR and lower the potential of the VBGR so as to make the value of the VBGR close to the target value. Further, when the potential of the VBGR is low, it is possible to increase the resistance between the node NDR5C and the VBGR to make the potential of the VBGR close to the target value. In this way, in the bandgap circuit of FIG. 6 as well, it is possible to adjust the potential of the VBGR.

As explained with reference to FIG. 1 to FIG. 6, in the past, various bandgap circuits (reference voltage circuit) able to adjust the output voltage are proposed.

The circuit of FIG. 1 includes the advantages of being simple in circuit configuration and being able to generate a reference voltage (bandgap voltage), but includes the problem of a large effect by the offset voltage of the operating amplifier.

The circuit of FIG. 3 may adjust the bandgap voltage by the number of PNP transistors used, so even in the case where the offset voltage of the operating amplifier causes the VBGR potential to deviate from the design value, the bandgap voltage may be made to approach the target value.

However, if trying to increase the amount of adjustment of the bandgap voltage to adjust the bandgap voltage VBGR by the number of PNP transistors used, there are the problems that the number of the PNP transistors becomes greater and the area increases.

Further, by inserting the switches (SWD1 and SWU1 to SWU4) to the bases of the PNP transistors used and turning the switches ON, the number of the PNP transistors is adjusted, so the base current flows to the control switches (SWD1 and SWU1 to SWU4).

The product of the ON resistance of the switch and the flowing current becomes a voltage drop at the switch. The base potential is made to fluctuate. Further, if the base potential fluctuates, the bandgap voltage VBGR also changes. For this reason, to make the error due to the insertion of a switch as small as possible, it is prefereble to make the base current smaller or make the ON resistance of the switch smaller.

If the current amplification rate of a PNP transistor is not sufficiently large, the value of the base current is small and, further, the effect of the ON resistance of the switch is small. However, the substrate PNP transistor generally used in the CMOS process (vertical direction transistor using source and drain diffusion layer of pMOS transistor as emitter, N-well as base, and P-substrate as collector) usually includes a small current amplification rate.

For this reason, when produced by a standard CMOS process, it is preferable to make the ON resistance of a switch as small as possible. That is, to avoid the output voltage from fluctuating at the switch itself due to adjustment of the VBGR potential, the ON resistance of the switch may be made smaller. This also invites an increase in the area of the switch.

The circuit of FIG. 5 may change the current mirror ratio to adjust the bandgap voltage. In the same way as the circuit of FIG. 3, there is the advantage that even when the VBGR potential deviated from the design value due to the offset voltage of the operating amplifier, it is possible to make the bandgap voltage approach the target value.

However, in the circuit of FIG. 5, the accuracy of the magnitude of the current flowing through the transistors Q1 and Q2 is determined by the relative precision of the pMOS transistors determining the current. There is the new issue that the degree of match of devices of pMOS transistors becomes a factor in error of the output voltage VBGR.

Further, to improve the relative precision, it is prefereble to produce MOS transistors by a certain size or more. This may also lead to an increase in area of the bandgap circuit.

The circuit of FIG. 6 may adjust the value of the resistance by switches to adjust the potential of the bandgap output VBGR. Due to this, even when the potential of the VBGR deviated due to the offset voltage of the operating amplifier, it is possible to make the VBGR potential approach the target value.

However, in the circuit of FIG. 6, it is preferable to design the ON resistances of the switches to be sufficiently small. The areas of the switches therefore increase. Further, the ON resistances of the switches fluctuate due to the power source voltage and temperature, so unless the ON resistances of the switches are made smaller than the resistance values of the resistor devices, the potential of the VBGR itself will end up fluctuating due to the effect of fluctuation of the ON resistances of the switches.

That is, in the circuit of FIG. 6 as well, due to the flow of current to the switches, it is preferable to design the ON resistances of the switches sufficiently small. There was therefore the problem of inviting an increase in the area occupied.

Below, embodiments of the reference voltage circuit (bandgap circuit) and semiconductor integrated circuit will be explained in detail with reference to the attached drawings.

Figure 7:
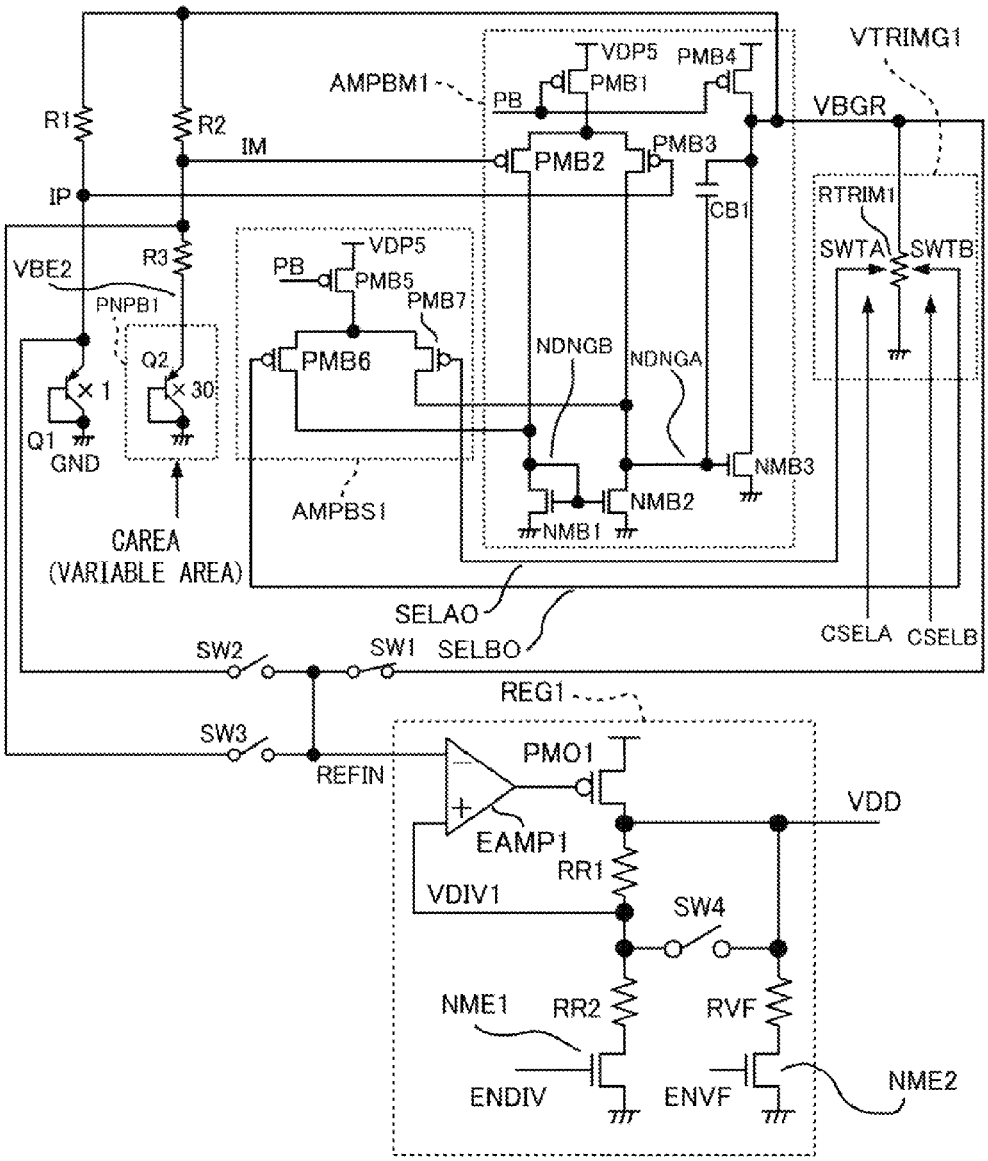
FIG. 7 is a circuit diagram illustrating a bandgap circuit of a first embodiment.

FIG. 7 is a circuit diagram illustrating a bandgap circuit (BGR circuit) of a first embodiment. In FIG. 7, reference notation Qn (n is an integer) indicates a PNP bipolar transistor, Rn (n is an integer) indicates a resistor and its resistance value, GND, for example, indicates a 0V GND terminal (first power source line), VDP5 indicates, for example, a 5V power source terminal (second power source line), and, further, VBGR, for example, indicates a 1.2V output reference potential.

Further, reference notation PMBn (n is an integer) indicates a pMOS transistor, NMBn (n is an integer) indicates a n-channel type MOS transistor (nMOS transistor), and, further, CB1 indicates a capacitor.

Furthermore, reference notation AMPBM1 indicates a main amplifier acting in the same way as the AMP1 of FIG. 1 (first amplifier), AMPBS1 indicates an offset adjustment-use auxiliary amplifier (second amplifier), and, further, SELAO and SELBO indicate input signals of the auxiliary amplifier.

Further, reference notations SWTA and SWTB indicate switches (selectors) which generate potential for offset adjustment, CSELA and CSELB indicate control signals of selectors for outputting SELAO and SELBO, and, further, RTRIM1 indicates a resistor for trimming.

Furthermore, reference notation VTRIMG1 indicates an offset adjustment voltage generation circuit which generates SELAO and SELBO, PB indicates a bias potential, and, further, VBE2, NDNGB, NDNGA, IP (first coupling node), and IM (second coupling node) indicate internal nodes.

Further, reference notation REG1 indicates a regulator circuit (coupling node potential takeout circuit), SW1 (third switch), SW2 (first switch), and SW3 (second switch) indicate switches for selecting the reference voltage of a regulator, REFIN indicates a reference voltage of a regulator circuit, and VDD indicates internal voltage which is output from the regulator circuit (for example, 1.8V).

Further, reference notation EAMP1 indicates an error amplifier, RR1 and RR2 indicate resistors forming a voltage division circuit, ENDIV indicates an enable signal of a voltage division circuit, PM01 indicates an output transistor of a regulator, and, further, SW4 (fourth switch) indicates a switch which is used for enabling operation as a voltage follower.

Furthermore, reference notation ENVF indicates an enable signal of a voltage follower, NME1 and NME2 indicate nMOS transistors inside a regulator, VDIV1 indicates a voltage division circuit output which is input to an error amplifier, and RVF indicates a resistor which is used for enabling operation as a voltage follower.

In the other drawings as well, Qn (n is an integer etc.), Rn (n is an integer etc.), etc. indicate the same content unless particularly indicated otherwise. The suffixes added to BJT (bipolar transistor) indicate the ratio of a relative area of the BJT (example of area ratio). In the other figures as well, similar content is illustrated.

Note that, the circuit devices and nodes etc. corresponding to the related circuits such as FIG. 1 are illustrated the same device names and node names. Unless otherwise indicated, the corresponding devices and nodes in the figures are assigned the same names and overlap in explanation is avoided.

Next, the operation of the bandgap circuit of the first embodiment illustrated in FIG. 7 will be explained. In FIG. 7, Q1, Q2, R1, R2, R3, and the main amplifier AMPBM1 operate as the bandgap circuit which outputs a 1.2V reference voltage the same as the related circuit of FIG. 1.

There is no difference between the related circuit of FIG. 1 and the circuit parts (Q1, Q2, R1, R2, R3, and main amplifier AMPBM1) which output the 1.2V reference voltage of the circuit of the first embodiment of FIG. 7. That is, the difference of the circuit of FIG. 1 and the circuit of FIG. 7 first lies in the point that the output of the offset adjustment-use auxiliary amplifier AMPBS1 is coupled in parallel to the internal nodes NDNGB and NDNGA of the main amplifier AMPBM1.

Further, in the first embodiment which is illustrated in FIG. 7, switches SW1, SW2, and SW3 are provided for taking out the potentials of the nodes IM and IP as the output voltage VDD of the regulator circuit REG1. Note that, the potentials of IP and IM correspond to the potentials of the two inputs of AMPBM1.

Furthermore, in the first embodiment which is illustrated in FIG. 7, a switch SW4 is provided for using the regulator circuit REG1 as a voltage follower. Further, these are combined to make the emitter area of the transistor Q2 variable. This emitter area is controlled by the control signal CAREA. Note that, the reference notation PNPB1 in FIG. 7 illustrates the circuit of the transistor Q2 in which the emitter area is made variable by the control signal CAREA (variable PNP area circuit).

While partially overlapping with the explanation of FIG. 1, the operations of the transistors Q1 and Q2, resistors R1, R2, and R3, and main amplifier AMPBM1 will be explained. The action of the auxiliary amplifier AMPBS1 will be explained later. Here, the explanation will be proceeded with assuming that the auxiliary amplifier does not affect the operation of the main amplifier.

Note that, the transistors Q1 and Q2 are drawn as PNP transistors, but if PN junction devices having PN junctions (first and second PN junction devices), they need not be PNP transistors. Further, the resistors R1, R2, and R3 are drawn as resistance devices, but they need not be resistors if load devices.

Due to feedback control of the main amplifier AMPBM1, the potentials of IM and IP match, so by setting the value of R1 and the value of R2 to, for example, 1:3.3, it is possible to design the current flowing through Q1 and the current flowing through Q2 to, for example, 1:3.3.

That is, for example, by making the current flowing through Q1 3.3 times the current flowing through Q2 and making the emitter area of Q2 20 times the emitter area of Q1, the difference ΔVBE of the VBE's of Q1 and Q2 is, for example, expressed by the following formula (15). At 300 k (ohms), i becomes 120 mV or so.

$$\Delta VBE=(kT/q)ln(99)=26\text{ mV}\times 4.5951=119.47\text{ mV} \qquad \text{formula (15)}$$

Further, the potential difference across the two ends of R3 becomes ΔVBE, so it is possible to amplify ΔVBE by (R2/R3) and add the result to VBE1 so as to generate the bandgap voltage VBGR (1.2V) like in the following formula (16) in the same way as the circuit of FIG. 1.

$$VBGR=VBE1+\Delta VBE(R2/R3) \qquad \text{formula (16)}$$

The main amplifier AMPBM1, for example, is comprised of the pMOS transistors PMB1, PMB2, PMB3, and PMB4, nMOS transistors NMB1, NMB2, and NMB3, and capacitor CB1.

The main amplifier AMPBM1 which is illustrated in FIG. 7 is a general two-stage amplifier. PMB1 acts as a tail current source of a differential pair. Further, PMB2 and PMB3 act as differential input transistors. Further, NMB1 and NMB2 act as first stage load transistors of the two-stage amplifier AMPBM1.

PMB4 acts as a current source operating as a second-stage load of the two-stage amplifier AMPBM1, while NMB3 acts as a second-stage source ground amplification transistor and further CB1 acts as a phase compensation capacitor. Note that, PB is assumed to indicate the bias potential of the current source.

When the input conversion offset voltage of the main amplifier AMPBM1 is zero mV and there is no auxiliary amplifier AMPBS1, the potentials of the nodes IM and IP become equal. However, in an actual integrated circuit, the input conversion offset voltage of the main amplifier AMPBM1, for example, includes a value of about +10 mV to −10 mV and becomes a value different for each specimen.

Consider the case where when the offset voltage of the main amplifier AMPBM1 is a potential where the potential of IM is, for example, +10 mV higher than the potential of IP, the feedback circuit of the main amplifier AMPBM1 is stable.

Here, first, assume that NMB1 and NMB2 include exactly the same characteristics and (the absolute value of) the threshold voltage Vth of PMB3 is a value 10 mV higher than (the absolute value of) the threshold voltage Vth of the PMB2.

Considered by the main amplifier AMPBM1 alone, when VBGR becomes 1.2V (in potential), the current flowing through the PMB4 and the current flowing through the NMB3 may be values of the same extent. Here, the bias potential PB of the PMB4 is generally set to an extent so that (the absolute value of) the gate-source voltage of the PMB4 slightly exceeds the threshold voltage Vth of the pMOS transistor, so here the explanation will be proceeded with assuming this.

The current flowing through the NMB3 becomes a value of about the same extent as the current flowing through the PMB4, so the potential of the gate voltage NDNGA of the NMB3 also may be of an extent slightly over the threshold voltage Vth of the nMOS transistor.

Assuming that (the absolute value) of the threshold voltage Vth of PMB3 is a value of 10 mV higher than (the absolute value) of the threshold voltage Vth of PMB2, when the potential of IM is a potential +10 mV higher than the potential of IP, the currents flowing through the PMB2 and PMB3 become equal.

To simplify the explanation, if assuming that NMB1 and NMB2 include exactly the same characteristics, the currents flowing through the NMB1 and NMB2 are the same, so the gate voltages and drain voltages become the same. That is, when the potential of IM is a potential +10 mV higher than the potential of IP, the potential of NDNGA and the potential of NDNGB become the same potential of an extent slightly exceeding the threshold voltage Vth of the nMOS transistor.

Next, the action of the offset adjustment-use auxiliary amplifier AMPBS1 will be explained. The auxiliary amplifier AMPBS1 is comprised of the pMOS transistors PMB5, PMB6, and PMB7. The drains of the PMB6 and PMB7 forming a differential circuit are coupled to the internal nodes NDNGB and NDNGA of the main amplifier AMPBM1.

PMB5 acts as the tail current source of the differential circuits PMB6 and PMB7. To facilitate the explanation, the explanation will be given assuming the threshold voltages Vth of the PMB6 and PMB7 are the same.

The auxiliary amplifier AMPBS1 is provided as a circuit for adjusting the gate voltages SELBO and SELAO of the PMB6 and PMB7 and canceling out the offset voltage of the main amplifier AMPBM1.

When the potentials of SELBO and SELAO are equal, the currents flowing through the PMB6 and PMB7 are equal, so there is no effect on the conditions for making the potential of the NDNGA and the potential of the NDNGB with the main amplifier AMPBM1 alone.

That is, if (the absolute value of) the threshold voltage Vth of the PMB3 becomes a value 10 mV higher than (the absolute value of) the threshold voltage Vth of the PMB2, the potential of IM becomes a voltage +10 mV higher than the potential of IP.

Here, assume that the current of the PMB5 and the current of the PMB1 are equal and further that the sizes (W) of the PMB2, PMB3, PMB6, PMB7 are equal. (The absolute value of) the threshold voltage Vth of the PMB3 is larger than (the absolute value of) the threshold voltage Vth of PMB2 and it is hard for current to flow to the PMB3, so with the main amplifier AMPBM1 alone, in the state where the potential of IP is lower than IM, the potentials of NDNGB and NDNGA become equal.

With the main amplifier AMPBM1 alone, it is hard for the current to flow to the PMB3, so consider making the gate potential SELAO of the PMB7 of the auxiliary amplifier AMPBS1 a potential 10 mW lower than the gate potential SELBO of the PMB6.

When the differential voltage of the gate potential of PMB7 and the gate potential of PMB6 is 10 mV, the current flowing through the PMB7 becomes one-half of the tail current IPMB5 of PMB5 plus a certain increase ΔI (IPMB5/2)+ΔI. The current flowing through the PMB6 becomes (IPMB5/2)−ΔI.

If making the gate potential SELAO of the PMB7 of the auxiliary amplifier AMPBS1 a potential 10 mV lower than the gate potential SELBO of the PMB6, the current of the PMB7 increases and the current of PMB6 decreases.

Due to this, conditions where the currents flowing through the NMB1 and NMB2 become equal and the potentials of the NDNGB and NDNGA become equal are better than when considered by the main amplifier AMPBM1 alone in that the current flowing through the PMB3 becomes smaller than the current flowing through the PMB2 by ΔI.

When the current of PMB5 and the current of PMB1 are equal and, further the sizes (W) of the PMB2, PMB3, PMB6, and PMB7 are equal, the condition whereby the current flowing through the PMB3 becomes smaller than the current flowing through the PMB2 by ΔI becomes the point of (the absolute value of) the effective gate voltage of the PMB3 becoming 10 mV larger than (the absolute value of) the effective gate voltage of the PMB2.

(The absolute value of) the threshold voltage Vth of the PMB3 becomes a value 10 mV higher than (the absolute value of) the threshold voltage Vth of the PMB2, so when the potential of IM and the potential of IP become equal, the potentials of NDNGB and NDNGA become equal and VBGR becomes 1.2V (or so in potential).

That is, when in a situation where there is an input conversion offset and it is difficult for current to flow to either of the PMB2 or PMB3, it is possible to supply currents for compensating for this from the PMB6 and PMB7 so as to cancel out the offset voltage of the main amplifier AMPBM1 so that the circuit balances when the potential of IM and the potential of IP are equal.

To control the currents of the PMB6 and the PMB7 so as to compensate for the unbalance of currents of PMB2 and PMB3, it is sufficient to make the gate potentials of the PMB6 and PMB7 different potentials and to make the gate potential of the transistor for carrying more current a potential lower than the other.

By this framework, it is possible to use the auxiliary amplifier AMPBS1 to cancel out the offset voltage of the main amplifier AMPBM1.

In the above explanation, the operation of the circuit was explained assuming that there is a difference of the threshold voltages Vth at just PMB2 and PMB3 and that the threshold voltages Vth of NMB1 and NMB2 completely match, but in an actual circuit, the causes of offset voltage include mismatch of NMB1 and NMB2 in addition to mismatch of PMB2 and PMB3.

The case where the threshold voltages Vth of the PMB2 and PMB3 match and the threshold voltage Vth of the NMB1 is larger than the threshold voltage Vth of the NMB2 will be explained.

By just the main amplifier AMPBM1, when the potential of the IM and the potential of the IP are equal, the currents which PMB2 and PMB3 try to carry are equal. If the threshold voltage Vth of the NMB2 is smaller, the current which the NMB2 tries to carry is larger than the current which the NMB1 tries to carry.

For this reason, the potential of the node NDNGA becomes lower. The current of the NMB3 becomes smaller, so the potential of VBGR rises. If the potential of the VBGR rises, the change of the potential of IP is small, so the potential of IM becomes higher than the potential of IP.

In this way, even if the threshold voltages Vth of NMB1 and NMB2 do not match, an input conversion offset occurs. A current easily runs through the NMB2, so it is preferable to run a larger current to the PMB3. The potential of IP becomes lower than the potential of IM in the operation.

In such a case as well, in the final analysis, it is possible to increase the current of PMB7 to supply a current which excessively flows to the NMB2 and thereby cancel out the input conversion offset as seen from the IP and IM nodes.

As explained above, there are various factors causing offset of the main amplifier AMPBM1, but it is possible to supply currents which correct the unbalance occurring at NDNGB and NDNGA from the PMB6 and PMB7 of the auxiliary amplifier AMPBS1 so as to make the input conversion offset of the main amplifier AMPBM1 approach zero. Due to this, the advantageous effect is obtained of enabling improvement of the precision of the potential of the VBGR.

Next, the method of generation of the gate voltage of the auxiliary amplifier AMPBS1 will be explained. First, the offset voltage of the main amplifier AMPBM1 is hopefully a value of from +10 mV to −10 mV or so as already explained.

In this regard, it is learned from the circuit configuration that there is an offset voltage in the auxiliary amplifier AMPBS1 itself. That is, this is because, for example, if the PMB6 and PMB7 are mismatched in threshold voltages Vth, even if the gate potentials SELBO and SELAO of the PMB6 and PMB7 are the same potentials, the currents flowing through the PMB6 and PMB7 become different values.

Therefore, it is sufficient to give the SELBO and SELAO a potential difference so that the input conversion offset of the main amplifier AMPBPM1, as seen from the IP and IM nodes, including the offset voltage of the auxiliary amplifier AMPBS1 generated at PMB6 and PMB7, becomes zero.

For example, if configuring the circuit so as to enable the potential difference of SELBO and SELAO to be adjusted by 1 mV increments from −20 mV to +20 mV, it is possible to adjust the offset voltage of the main amplifier AMPBM1 to about zero. However, if making the increments for voltage adjustment and resolution 1 mV, residual offset of about 1 mV remains.

The temperature dependency and power source voltage dependency of the offset voltage are hard to predict and further may take various forms. For example, there are cases where the offset voltage becomes larger if the temperature rises and cases where the offset voltage becomes smaller if the temperature rises.

Furthermore, the relationship between the power source voltage and the offset voltage may also be positive or negative. Under such conditions, to effectively cancel out the offset voltage as much as possible, it is preferable to assume an intermediate case of positive and negative dependency where the offset is not dependent on the temperature or power source voltage and generate the gate voltages SELBO and SELAO for canceling out the offset voltage.

In the bandgap circuit of the present first embodiment, as a method of generation of a gate voltage not dependent much on the power source voltage or temperature along with this object, the method of dividing the bandgap circuit output VBGR for use is employed.

That is, the potentials of IP and IM are about 0.6V, so to match the operating conditions of PMB2, PMB3, PMB6, and PMB7 as much as possible, the potential of VBGR is divided into about ½ for use as the potential. The VTRIMG1 of FIG. 7 works as a circuit for generating gate voltages SELAO and SELBO for adjusting the offset voltage of the main amplifier AMPBM1 to zero.

The potential of VBGR is divided by the resistor RTRIM1, the divided voltage is selected from the plurality of divided voltages by the switches SWTA and SWTB, and the selected outputs SELAO and SELBO are supplied as gate potentials of the PMB6 and PMB7 of the auxiliary amplifier AMPBS1. Here, CSELA and CSELB indicate control signals of selectors for outputting SELAO and SELBO. These CSELA and CSELB are used to determine the selected potential.

The circuit of the configuration such as VTRIMG1 of FIG. 7 generates gate voltages SELAO and SELBO for adjusting the offset voltage to zero. Due to this, it is possible to realize characteristics where the potential difference of the gate voltages SELBO and SELAO for canceling out the above-mentioned offset voltage is not dependent on the temperature or power source voltage.

Next, the control signals CSELA and CSELB and the control of the potentials of the gate voltages SELAO and SELBO right after turning on the power will be briefly explained. The operations of these parts will be explained in detail later.

The bandgap circuit is, for example, used as a circuit for generating the reference voltage of the regulator circuit, so may be operated from right after turning on the 5V power source VDP5.

In this regard, when starting the bandgap circuit of FIG. 7, the internal voltage VDD generated by the regulator circuit still will not become the given potential (for example, 1.8V) but will be 0V.

Figure 19:
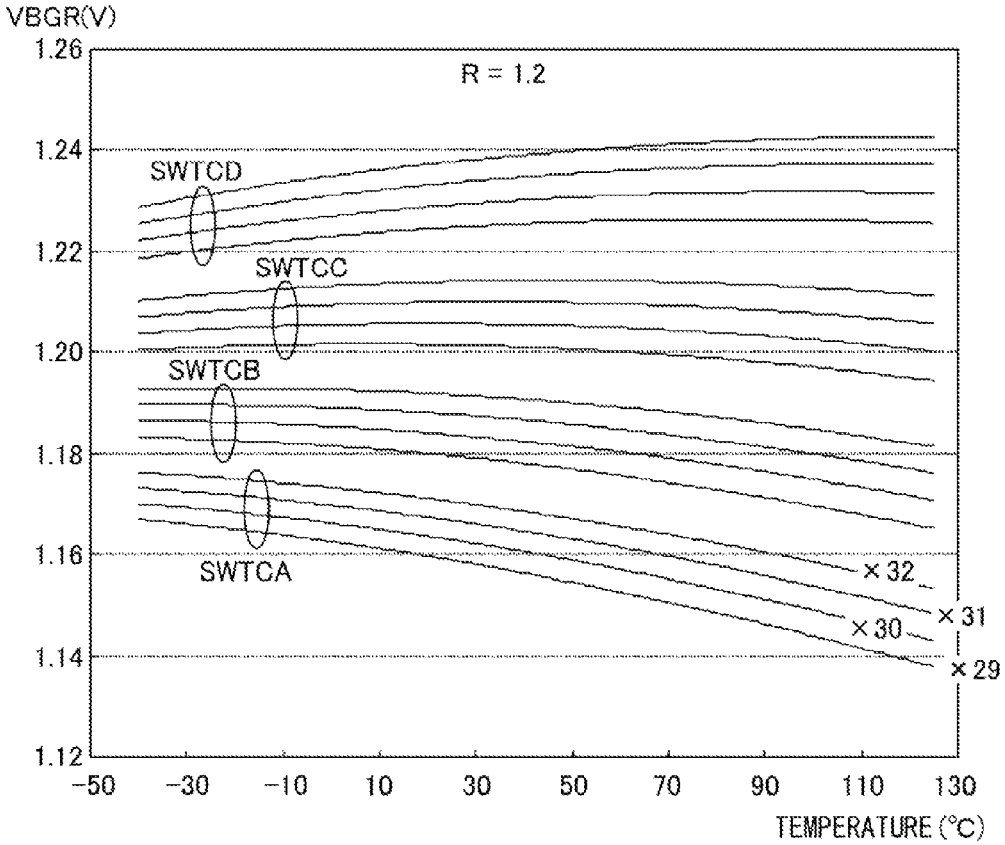
FIG. 19 is a view illustrating the relationship between temperature and an output voltage in a bandgap circuit of the present embodiment (part 3)

Note that, assume that the settings of the gate voltages SELBO and SELAO for canceling out the offset voltage of the main amplifier AMPBM1, for example, as illustrated in the later explained FIG. 19, are stored in the nonvolatile memory FLASH1 on the chip.

Right after turning on the power source VDP5, the internal voltage VDD is 0V, so the logic circuit which operates by the internal voltage also operates as a memory (FLASH1). For this reason, right after turning on the power source, the offset adjustment-use auxiliary amplifier AMPBS1 may not be given a gate voltage for canceling out the offset voltage of the main amplifier AMPBM1.

Even under this state, for example, if configuring the circuit so that the potentials of SELBO and SELAO right after input of VDP5 become equal, the potential includes error due to the offset voltage, but it is possible to design the potential of VBGR to become a potential of about 1.2V.

In the state including error due to the offset voltage of the main amplifier AMPBM1, the potential of VBGR stabilizes. If the potential of the internal voltage VDD becomes a voltage of about 1.8V due to the regulator circuit, the state becomes one in which the flash memory FLASH1 may be accessed.

When reading out the flash memory FLASH1, the settings of the gate voltages SELBO and SELAO for canceling out the offset voltage of the main amplifier are read out from the FLASH1 and the offset voltage of the main amplifier AMPBM1 is cancelled. Due to this, the potential of the VBGR changes to a potential closer to the ideal value. Furthermore, the potential of the VDD also changes to a value closer to the given design value.

As illustrated in the later explained FIG. 19, the nonvolatile memory FLASH1 stores settings of the gate voltages SELBO and SELAO for canceling out the offset voltage of the main amplifier AMPBM1. Further, after the power is turned on, it is possible to set the potentials of SELBO and SELAO at certain fixed values, generate the potential of the VBGR, and operate the regulator circuit so as to generate the internal voltage VDD.

After this, by reading out the gate voltage settings for canceling the prestored offset voltage from the nonvolatile memory and by canceling the offset voltage of the main amplifier, it becomes possible to request operation right after turning on the power and improve the precision of the bandgap voltage after startup.

Next, the switches SW1, SW2, SW3, and SW4 will be explained. First, the selectors (switches) SWTA and SWTB are used to adjust the gate voltages of PMB6 and PMB7 to adjust the offset voltage of the main amplifier (operational amplifier) AMPBM1 to substantially zero. At this time, the potential of IP (first coupling node) and the potential of IM (second coupling node) become substantially equal, the circuit balances, and the potential of VBGR becomes substantially the bandgap potential as explained above.

SW1 to SW4 are used in the process of adjusting this offset voltage to zero. That is, for example, even if monitoring the potential of VBGR, it is not possible to directly learn if the offset voltage of the main amplifier AMPBM1 becomes zero. Therefore, the switches SW1 to SW4 are used to confirm that the potentials of the nodes IP and IM are equal potentials.

First, at the time of normal operation, only SW1 becomes ON. SW2, SW3, and SW4 are OFF. Further, ENVF is the low level "L", while ENDIV is the high level "H".

If SW1 is ON, the potential of the reference voltage REFIN of the regulator REG1 becomes the bandgap potential VBGR. Here, if SW4 is OFF and ENVF is "L", RVF includes no effect on the operation.

Further, if ENDIV is "H", the nMOS transistor NME1 is ON, so the potential of VDIV1 becomes the potential of VDD divided by RR1 and RR2. Further, due to the error amplifier EAMP1, the potential of REFIN and the potential of VDIV1 become equal and the circuit stabilizes.

Specifically, for example, if making the ratio of the resistance values of RR1 and RR2 1:2, the potential of VDIV1 becomes a potential equal to the bandgap voltage 1.2V, so it is possible to control the potential of VDD to 1.8V.

The auxiliary amplifier AMPBS1 and the switches SW1 and SW2 are used to adjust the offset voltage of the main amplifier AMPBM1 to zero. SW1 is turned OFF, SW4 is turned ON, the potential of VDD is made the potentials of IP and IM, it is confirmed that the potentials of IP and IM are equal potentials, and the potentials SELAO and SELBO of SWTA and SWTB are adjusted.

First, the operation in the case of taking out the potential of the node IP as the potential of VDD will be explained. SW1 is turned OFF, SW2 is turned ON, and, furthermore, SW3 is turned OFF. Due to this, the potential of REFIN becomes the potential of the node IP.

Furthermore, SW4 is turned ON, ENVF is made "H", and ENDIV is made "L". That is, SW4 is ON and ENDIV is "L", so the potential of VDIV1 becomes the potential of VDD. Further, since ENVF is "H", it is possible to prevent the potential of VDD from overly rising by flowing a current through the RVF.

Here, the regulator REG1 functions as the voltage follower, and the potential of VDD becomes the potential of REFIN. Further, due to the switch SW2, the potential of REFIN becomes the potential of IP, so the potential of VDD also becomes the potential of IP.

Next, the operation when taking out the potential of the node IM as the potential of VDD will be explained. SW1 is turned OFF, SW3 is turned ON, and, furthermore, SW2 is turned OFF. Due to this, the potential of REFIN becomes the potential of the node IM.

Furthermore, the SW4 is turned ON, ENVF is made "H", and, further, ENDIV is made "L". That is, SW4 is ON and ENDIV is "L", so the potential of VDIV1 becomes the potential of VDD. Further, since ENVF is "H", it is possible to prevent the potential of VDD from overly rising by flowing a current through the RVF.

Here, the regulator REG1 functions as a voltage follower. The potential of VDD becomes equal to the potential of REFIN. Further, due to the switch SW3, the potential of REFIN becomes the potential of IM, so the potential of VDD also becomes the potential of IM.

Here, the resistors R1, R2, and R3, for example, are often designed to high resistance values exceeding 100 kohms, so if directly taking out the potentials of IP and IM to the outside of the chip for measurement, it is not possible to measure the correct voltage.

Further, if a protective device of the input/output (I/O part etc. is coupled for leading the potential to the outside of the chip, the leakage currents of these devices sometimes influence the operation, so it is preferable to measure the potentials of IP and IM through the buffer amplifier.

In this regard, as illustrated in FIG. 7, in the bandgap circuit of the first embodiment, the regulator REG1 is used as a buffer amplifier for measuring the potentials of the nodes IP and IM. Further, just the switch SW2 is inserted at the node IP and just the switch SW3 is inserted at the node IM, so it is possible to take out the potentials of IP and IM to the VDD.

That is, in the state where the potentials of SELAO and SELBO are equal, SW2 is turned ON, the potential of IP is taken out to VDD, and the potential of IP is measured. Next, SW3 is turned ON, the potential of IM is taken out to VDD, and the potential of IM is measured.

Here, when the potential of IM is higher than the potential of IP by, for example, +10 mV, the gate potential SELAO of PMB7 of the auxiliary amplifier AMPBS1 is made a potential 10 mV lower than the gate potential SELBO of the PMB6.

That is, the settings of SWTA and SWTB at the offset adjustment voltage generation circuit VTRIMG1 are adjusted around the anticipated optimum gate voltage, and settings giving the smallest potential difference of IP and IM are adopted as the settings of the offset adjustment.

Note that, the regulator REG1 also includes an offset voltage, but the potentials of IP and IM are taken out and monitored by the same REG1, so the error due to REG1 does not include any effect on the conditions where IP and IM become equal potentials.

As explained in detail above, due to the switches SW1, SW2, SW3, and SW4 and the enable signals ENDIV and ENVF at the regulator REG1, it is possible to take out the potentials of the node IP and IM at the VDD. Further, by adopting the method of adjusting the offset to zero, even if the impedances of IP and IM are high, it becomes possible to measure the potentials of IP and IM by an external measuring device. Due to AMPBS1, the effect is obtained that it is possible to accurately adjust the offset to zero.

Next, a circuit using the control signals CAREA and CAREA to make the emitter area of the transistor Q2 variable will be explained.

First, the selectors (switches) SWTA and SWTB at the offset adjustment voltage generation circuit VTRIMG1 adjust the gate voltages of the PMB6 and PMB7 at the offset adjustment-use auxiliary amplifier AMPBS1 to adjust the offset voltage of the main amplifier AMPBM1 to zero.

When adjusting this offset voltage to zero, it was explained that it is possible to use SW1 to SW4 and the ENDIV and ENVF signals, take out the potentials of IP and IM at VDD, and adjust the offset voltage of AMPBM1 to zero so that the potential of IP and the potential of IM become equal.

However, even if the settings of SWTA and SWTB are finalized and the offset voltage of the main amplifier AMPBM1 become zero, causes remain for the potential of VBGR being off from the ideal design value. That is, the absolute values of resistors often fluctuate by about ±10% due to variations at the time of manufacture. Further, the absolute values of the forward direction voltage VBE of the PNP transistors also fluctuate by several mV.

Furthermore, if the resistance value is off, the current flowing through the circuit changes, so the value of VBE changes. As a result, the bandgap voltage (bandgap potential VBGR) fluctuates. Further, this bandgap voltage fluctuates even if the absolute value of VBE of the PNP transistor changes.

The amount by which the bandgap voltage deviates from the ideal value due to factors other than the offset voltage of the operational amplifier is corrected by CAREA and PNPB1. In FIG. 7, the emitter area of Q2 is made 30 times the area of Q1, but it is also possible to make the emitter area of Q2, for example, 29 times, 30 times, 31 times, and 32 times the area and perform control by the control signal CAREA to thereby finely adjust the potential of VBGR.

Here, due to feedback control of the main amplifier AMPBM1, the potentials of IM and IP match, so by designing the value of R1 and the value of R2 to, for example, 1:3.3, it is possible to design the current flowing through Q1 and the current flowing through Q2 to 3.3:1.

That is, for example, by making the current flowing through Q1 3.3 times the current flowing through Q2 and making the emitter area of Q2 30 times the emitter area of Q1, the difference ΔVBE of VBE of Q1 and Q2 is expressed for example by the following formula (15) and, at 300 k(ohms), becomes about 120 mV.

$$\Delta VBE=(kT/q)ln(99)=26\text{ mV}\times4.5951=119.47\text{ mV} \qquad \text{formula (15)}$$

Further, the potential difference across the two ends of R3 becomes ΔVBE, so ΔVBE is amplified to (R2/R3) times and the result added to VBE1 to generate the bandgap voltage (VBGR). That is, VBGR is expressed by the following formula (16).

$$VBGR=VBE1+\Delta VBE(R2/R3) \qquad \text{formula (16)}$$

Here, for example, if making the emitter area of Q2 29 times the emitter area of Q1, the difference ΔVBE of VBE of Q1 and Q2 is expressed by the following formula (17).

$$\Delta VBE=(kT/q)ln(95.7)=26\text{ mV}\times4.5612=118.59\text{ mV} \qquad \text{formula (17)}$$

Further, for example, if making the emitter area of Q2 31 times the emitter area of Q1, the difference ΔVBE of VBE of Q1 and Q2 is expressed by the following formula (18).

$$\Delta VBE=(kT/q)ln(102.3)=26\text{ mV}\times4.6279=120.33\text{ mV} \qquad \text{formula (18)}$$

Furthermore, for example, if making the emitter area of Q2 32 times the emitter area of Q1, the difference ΔVBE of VBE of Q1 and Q2 is expressed by the following formula (19).

$$\Delta VBE=(kT/q)ln(105.6)=26\text{ mV}\times4.6597=121.15\text{ mV} \qquad \text{formula (19)}$$

Further, by increasing the ΔVBE expressed by formula (15), formula (17), formula (18), and formula (19) (case of this example) about 5 times and adding the result to VBE1, a bandgap voltage is generated, so the area of Q2 is selected from, for example, 29 times, 30 times, 31 times, and 32 times the area. Due to this, it becomes possible to adjust ΔVBE in increments of about 1 mV. Furthermore, it is possible to change the bandgap voltage by about 5 mV.

In this way, by changing the area of Q2 by CAREA, it becomes possible to adjust the offset voltage of the main amplifier AMPBM1 to zero, then correct the remaining deviation of VBGR from the ideal value.

In this way, the areas of the PNP transistors are made variable to adjust the potential of VBGR. After adjusting the offset voltage of the operational amplifier to zero, it is sufficient to correct the deviation of the VBGR due to the deviation of absolute values of the resistors or correct deviation of VBGR due to deviation of VBE of the PNP transistors, so the range of adjustment may be made very narrow. Therefore, there is no need to greatly increase the number of the PNP transistors or change the area of the Q1 side.

When making the areas of the PNP's variable by combination with the offset adjustment mechanism of the operational amplifier like in FIG. 7, the mechanism for making the areas of PNP's variable may be auxiliary, so it is possible to avoid disadvantages such as the sharp increase in circuit size which becomes an issue when making VBGR variable by just the areas of the PNP's.

Above, the offset adjustment by the AMPBS1, the action of SW1, SW2, SW3, and SW4 in taking out the potentials of IP and IM at VDD, and the method of further adjustment of the potential of VBGR by CAREA after offset adjustment was explained. Next, details of the circuit configuration of the components will be explained in order.

Figure 8:
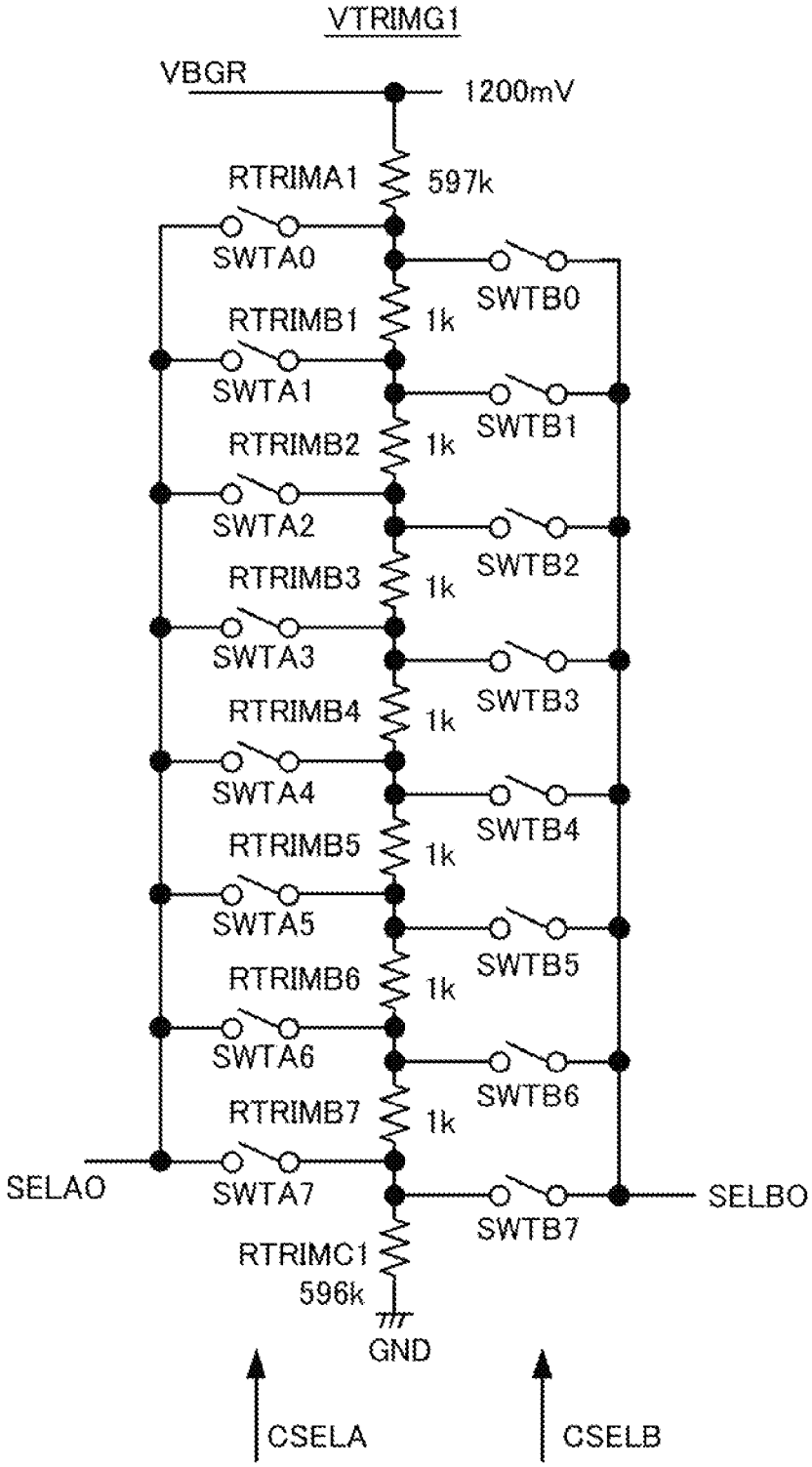
FIG. 8 is a circuit diagram illustrating an example of an offset adjustment voltage generation circuit in the bandgap circuit of FIG. 7.

FIG. 8 is a circuit diagram which illustrates one example of an offset adjustment voltage generation circuit (VTRIMG1) in the bandgap circuit of FIG. 7.

In FIG. 8, the reference notation VBGR indicates a bandgap output potential, RTRIMA1, RTRIMB1 to RTRIMB7, and RTRIMC1 indicates resistors, and, further, SWTA0 to SWTA7 and SWTB0 to SWTB7 indicate switches.

Furthermore, the reference notations SELAO and SELBO illustrate the voltage outputs for adjusting the offset voltage of the main amplifier to zero, GND illustrate the GND terminal (0V), and CSELA and CSELB illustrate control signals of selectors (switches SWTA and SWTB) for outputting the gate voltages SELAO and SELBO.

The suffixes attached to the resistors illustrate examples of the resistance values of the resistors (ohms). The circuit devices and nodes etc. corresponding to the circuit of FIG. 7 are illustrated the same device names and node names. Unless otherwise indicated, the corresponding devices and nodes in the figures are assigned the same names and overlap in explanation is avoided.

Next, the operation of the circuit of FIG. 8 will be explained. As stated in the explanation of FIG. 7, the potential of VBGR of FIG. 7 is divided by the resistors and the desired divided voltage is selected from the plurality of divided voltages by the selectors SWTA and SWTB.

The switches SWTA0 to SWTA7 (first switch group) act as selectors for obtaining the output SELAO. Further, the switches SWTB0 to SWTB7 (second switch group) act as selectors for obtaining SELBO.

The selected output voltages SELAO and SELBO are supplied as gate potentials of the transistors PMB6 and PMB7 of the auxiliary amplifier AMPBS1 of FIG. 7. Here, the reference notations CSELA and CSELB express control signals of a selector which outputs SELAO and SELBO. The potential selected is determined by the control signals CSELA and CSELB.

FIG. 8 illustrates an example where the total value of the resistors RTRIMA1, RTRIMB1 to RTRIMB7, and RTRIMC1 (resistor group) becomes 1200 kohms. That is, the value of the resistor RTRIMA1 becomes, for example, 597 kohms, the resistance values of the RTRIMB1 to RTRIMB7 become 1 kohm, and the resistance value of RTRIMC1 becomes 696 kohms.

The 1200 mV (or so) VBGR voltage is divided by the total 1200 kohm resistance array. At this time, the potential difference across the two ends of the 1 kohm resistor becomes 1 mV. Further, the point where the 600 mV potential is obtained becomes the potential of the node selected by SWTA3 and SWTB3.

That is, the potential selected by SWTA becomes 596 mV, that is, a potential higher in 1 mV increments toward SWTA0. Further, for example, by using the 3-bit signal CSELA so as to turn ON just one switch among SWTA0 to SWTA7, it is possible to generate a potential from 596 mV to 603 mV in 1 mV increments. Note that, the same is true for the potential selected by SWTB0 to SWTB7.

In this way, a circuit such as illustrated in FIG. 8 may be used to realize the function of the offset adjustment voltage generation circuit VTRIMG1 of FIG. 7. Note that, in FIG. 8, for simplification, the example of generating SELAO by a 3-bit signal CSELA was illustrated, but when the range of adjustment may be broad, it is clear that similar thinking may be used to realize a 4-bit or a 5-bit configuration. Further, in FIG. 8, resistance values were illustrated as a simple example, but when 0.5 mV increment adjustment signals SELAO and SELBO may be used, similar thinking may be used to set the resistance values needless to say.

By employing a configuration such as in FIG. 8, it is possible to prevent direct current from flowing to the SWTA0 to SWTA7 or the SWTB0 to SWTB7. The reason is that SELAO and SELBO are input to the gate electrodes of the transistors and are insulated DC wise.

From this, the ON resistances of SWTA0 to SWTA7 and SWTB0 to SWTB7 do not affect the adjustment operation of the offset voltage of the main amplifier. It is possible to avoid the undesirable phenomenon such as seen in the relative circuit where the ON resistance of the switch affects the output voltage.

As explained above, by combining the auxiliary amplifier of offset adjustment having the gate electrode of the MOS transistor as the input and the offset adjustment voltage generation circuit by the resistance voltage division circuit such as in FIG. 8 (circuit generating auxiliary amplifier input potential), it is possible to avoid the ON resistance of the switch from affecting the output voltage.

Figure 9:
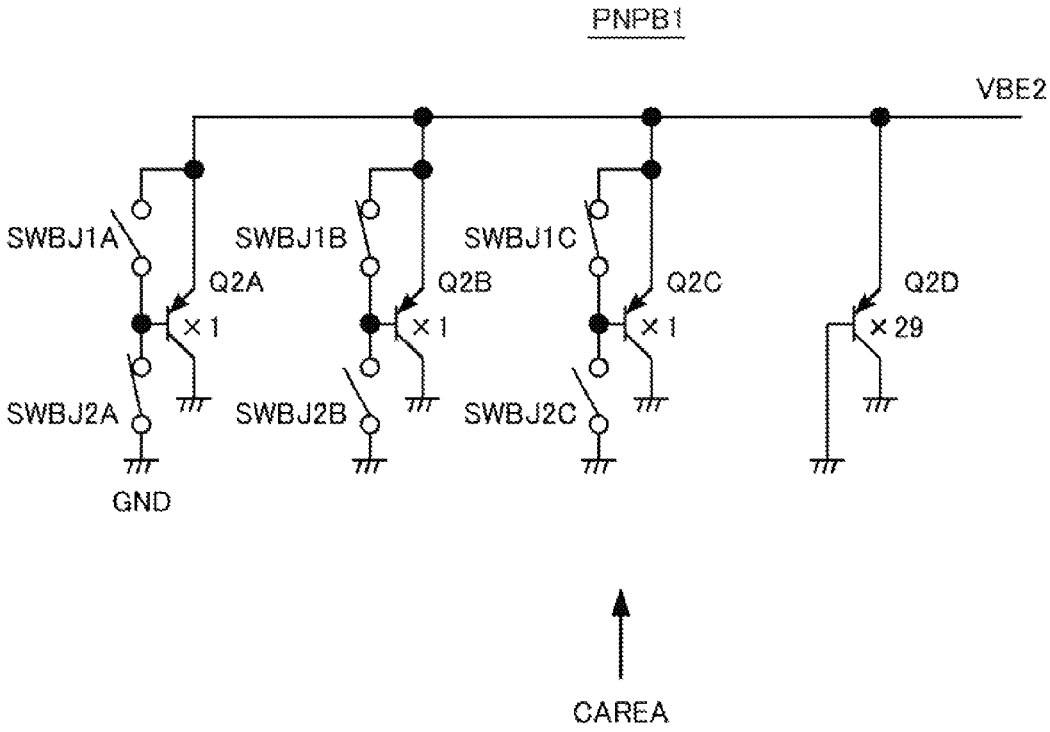
FIG. 9 is a circuit diagram illustrating an example of a variable PNP area circuit in the bandgap circuit of FIG. 7.

FIG. 9 is a circuit diagram illustrating one example of the variable PNP area circuit PNPB1 in the bandgap circuit of FIG. 7. This illustrates an example of a circuit using the control signal CAREA to make the emitter area of the PNP transistor Q2 variable. In FIG. 9, the reference notations SWBJ1A to SWBJ1C and SWBJ2A to SWBJ2C illustrate switches.

In FIG. 9, the PNP transistors Q2A to Q2D correspond to the PNP transistor Q2 of FIG. 7. Here, Q2A, Q2B, and Q2C are made PNP transistors of emitter areas of 1 time the area and Q2D is made a PNP transistor of an emitter area of 29 times the area. Note that, in an actual circuit, for example, 32 transistors of the same size are prepared and among these, 29 are kept constantly ON as the transistors Q2D.

Referring to FIG. 7, the explanation was given of using the control signal CAREA to make the emitter area of PNPB1 vary from 29 times to 32 times. In FIG. 9, the switches SWBJ1A and SWBJ2A are complementarily controlled. Similarly, the SWBJ1B and SWBJ2B and the SWBJ1C and SWBJ2C are complementarily controlled.

First, if SWBJ1A is OFF and SWBJ2A is ON, the base potential of Q2A becomes GND. That is, Q2A is ON. On the other hand, as illustrated in FIG. 9, if turning SWBJ1B ON and turning SWBJ2B OFF, the base potential of Q2B becomes equal to the emitter potential VBE2. That is, Q2B becomes OFF. In the same way, in the state illustrated in FIG. 9, Q2C is also OFF.

In this way, in addition to Q2D which is constantly ON, it is possible to select whether to turn Q2A, Q2B, and Q2C ON or OFF. Due to this, it becomes possible to select 29 times, 30 times, 31 times, and 32 times the emitter area by the control signal CAREA. Therefore, it is possible to use the variable PNP area circuit PNPB1 of FIG. 9 to make the area of Q2 variable and thereby adjust the potential of the VBGR.

Figure 10:
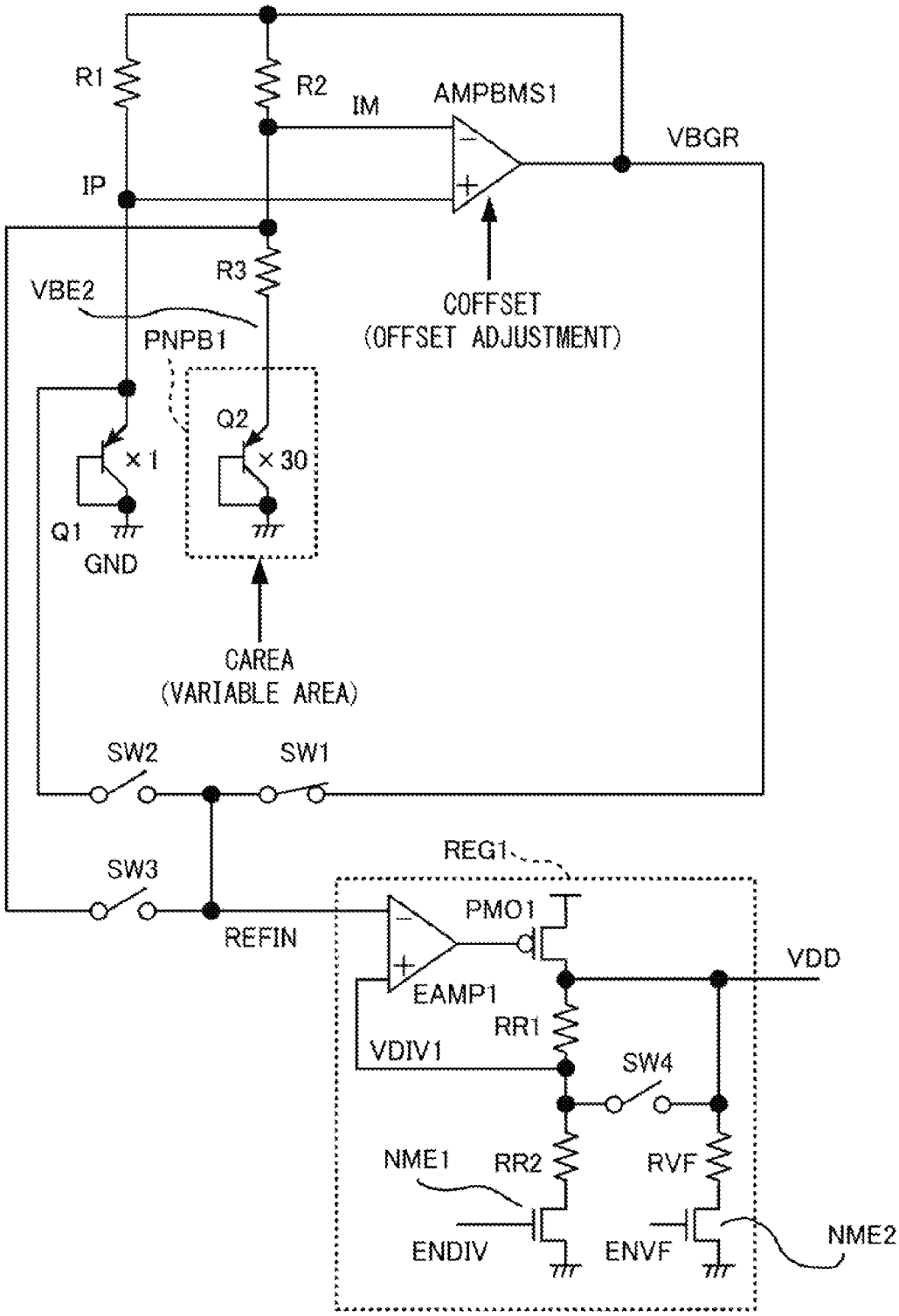
FIG. 10 is a circuit diagram illustrating a bandgap circuit of a second embodiment.

In the circuit of FIG. 7, as the method of offset adjustment of the operational amplifier, provision of an auxiliary amplifier AMPBS1 and a circuit generating the gate voltage by SWTA and SWTB was explained. FIG. 10 is a circuit diagram illustrating a bandgap circuit of the second embodiment.

As clear from a comparison of FIG. 10 and the above-mentioned FIG. 7, in the second embodiment, the operational amplifier (main amplifier) able to adjust the offset is indicated as AMPBMS1 and the offset adjustment signal is indicated as COFFSET.

In the first embodiment which is illustrated in FIG. 7, the auxiliary amplifier AMPBS1 was used as the offset adjustment circuit, but if using the main amplifier itself to adjust the offset, it is possible to combine this with the idea of the embodiment of taking out the potentials of IP and IM at VDD and adjusting the offset of the amplifier as illustrated by SW1, SW2, SW3, SW4, ENVF, and ENDIV.

Note that, so long as the amplifier AMPBMS1 is an operational amplifier which may adjust the offset by COFFSET, various ones may be used. Further, the potentials of IP and IM are taken out at VDD and the offset voltage of the AMPBMS1 is adjusted to zero by COFFSET by control of SW1, SW2, SW3, SW4, ENVF, and ENDIV.

Furthermore, the point of adjusting the offset voltage of the amplifier AMPBMS1 to zero, then adjusting the area of Q2 by CAREA to further correct the potential of VBGR is similar to the above-explained first embodiment.

That is, in the second embodiment of FIG. 10, if it is possible to adjust the offset voltage of the AMPBMNS1 by COFFSET, it is possible to combine the switching operations of the SW1 to SW4 and REG1 and PNPB1 etc. to obtain effects similar to the first embodiment.

That is, according to the bandgap circuit of the second embodiment, it becomes possible to adjust to zero the offset of the amplifier while monitoring the potentials of IP and IM. It is possible to adjust the offset of the amplifier to zero, then adjust the PNP area so further correct the VBGR potential.

Figure 11:
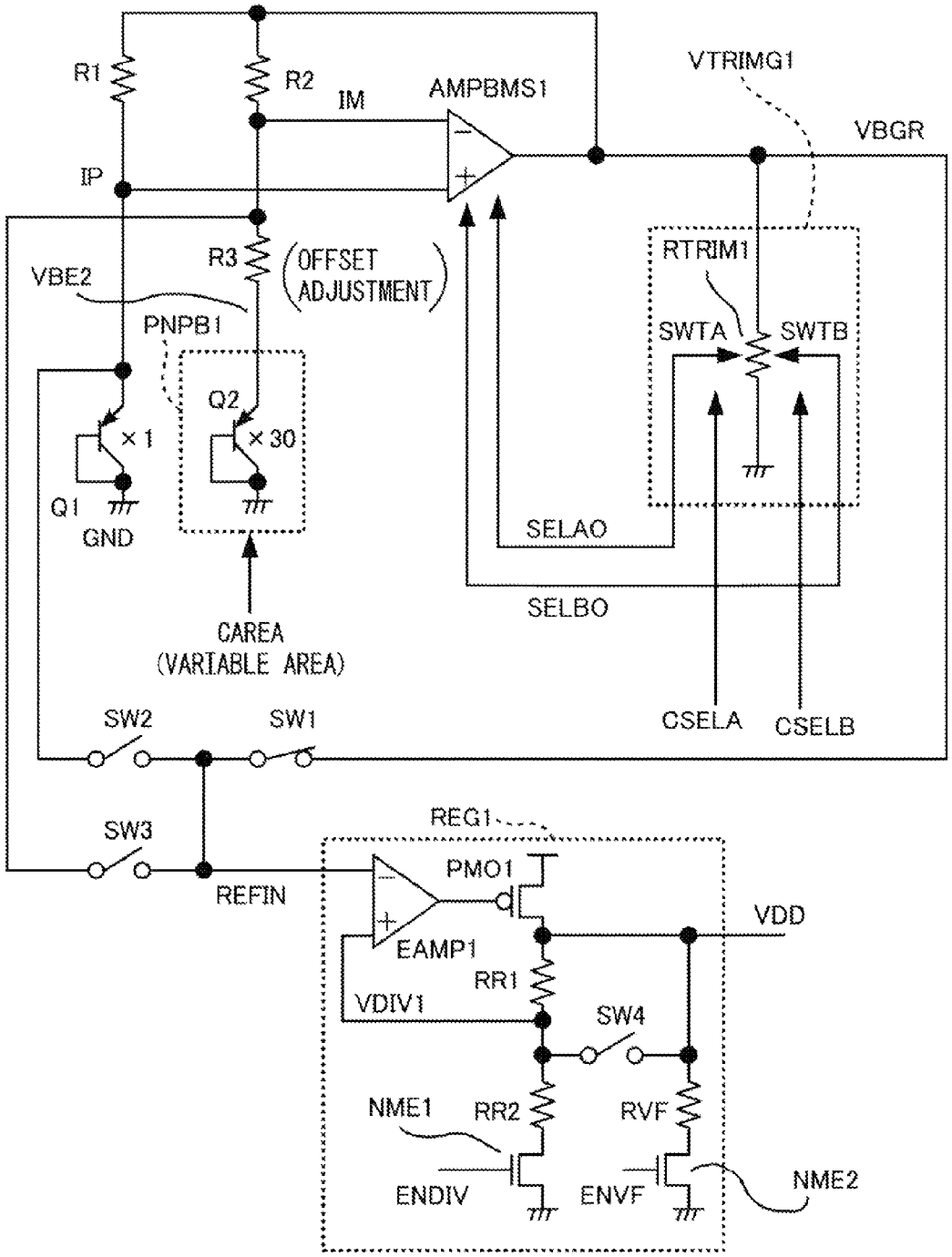
FIG. 11 is a circuit diagram illustrating a bandgap circuit of a third embodiment.

FIG. 11 is a circuit diagram which illustrates a bandgap circuit of a third embodiment. In the above-mentioned FIG. 10, the offset adjustment signal of the amplifier AMPBMS1 is illustrated as COFFSET, but in the third embodiment of FIG. 11, the offset adjustment signals are indicated as SELAO and SELBO.

That is, in the same way as the above-mentioned second embodiment, in the bandgap circuit of the third embodiment, the offset voltage of the amplifier AMPBMS1 is adjusted by the potentials SELAO and SELBO obtained by dividing VBGR by the resistor RTRIM1.

Therefore, as the amplifier AMPBMS1 illustrated in FIG. 11, for example, the case including both of the main amplifier AMPBM1 and the auxiliary amplifier AMPBS1 in FIG. 7 may be considered. However, the amplifier AMPBMS1 in the bandgap circuit of the third embodiment illustrated in FIG. 11 is not limited to a configuration including the AMPBM1 and AMPBS1 of FIG. 7. A configuration where offset adjustment is possible by SELAO and SELBO is also possible. Furthermore, various offset adjustment mechanisms in the amplifier AMPBMS1 may also be employed. The offset voltage of the AMPBMS1 may be adjusted by a potential obtained by dividing the VBGR.

Figure 12:
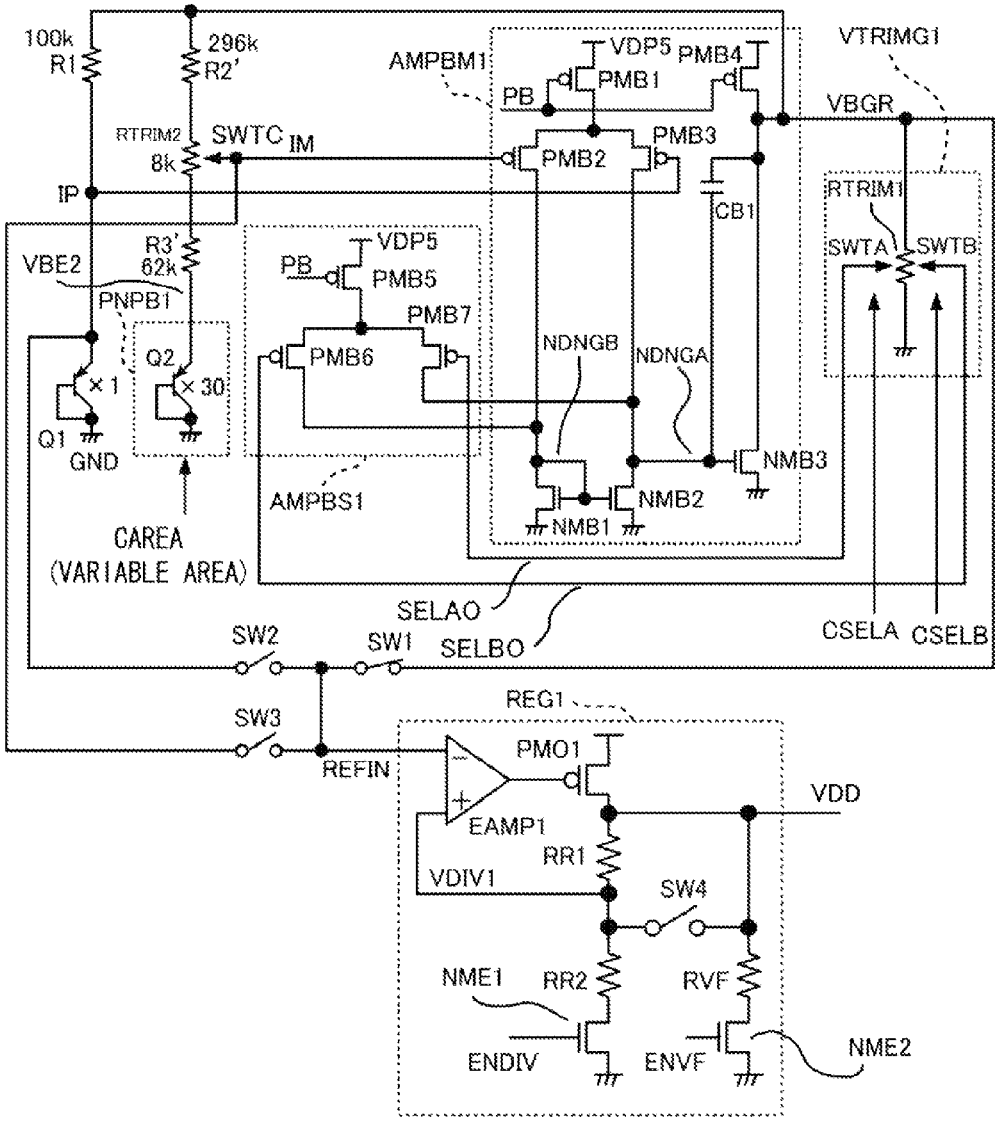
FIG. 12 is a circuit diagram illustrating a bandgap circuit of a fourth embodiment.

FIG. 12 is a circuit diagram which illustrates a bandgap circuit of a fourth embodiment. Ac clear from a comparison of FIG. 12 and the above-mentioned FIG. 7, in the fourth embodiment, the circuit is the same as the circuit of FIG. 7 minus the resistors R2', RTRIM2, R3', and SWTC, so the parts different from the circuit of FIG. 7 will be explained. Here, RTRIM2 is the resistance for trimming and is for controlling the ratio of R2 and R3.

As illustrated in FIG. 12, in the bandgap circuit of the fourth embodiment, it is possible to adjust the potential of the VBGR by the selector (switch) SWTC in addition to the PNPB1 and CAREA of the first embodiment of FIG. 7.

That is, it is possible to change the position for taking out the resistor RTRIM2 by SWTC and change the value of part of the resistance of RTRIM2 which is coupled between the resistor R2' and node IM. By using SWTC to change the position for taking out the potential of IM from the RTRIM2, the value of part of the resistance of the RTRIM2 which is coupled with the IM which is in series with the resistor R3' also changes.

Figure 16:
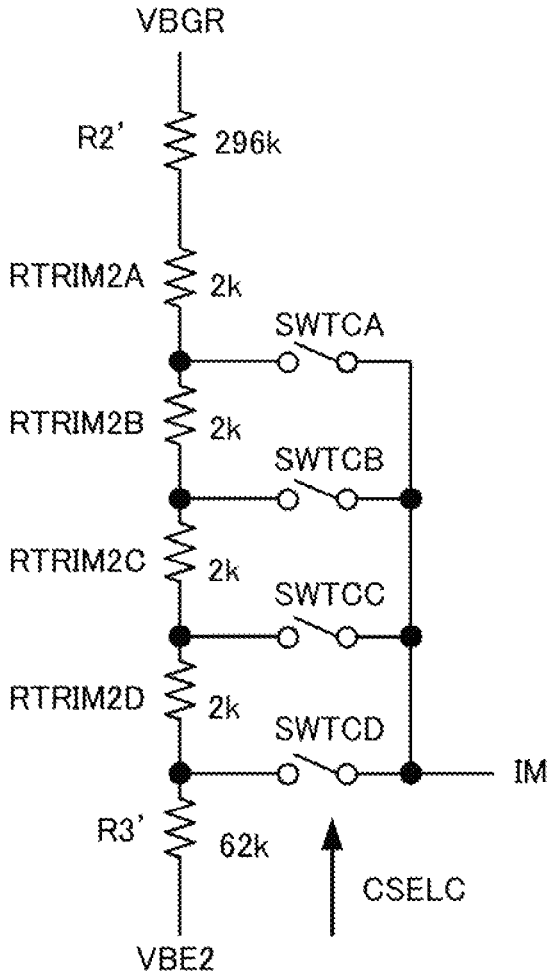
FIG. 16 is a circuit diagram illustrating an example of a variable resistance ratio circuit which is applied to a bandgap circuit of the present embodiment.

Next, referring to FIG. 16 in addition to FIG. 12, the selector SWTC will be explained in detail. FIG. 16 is a circuit diagram illustrating one example of a variable resistance ratio circuit which is applied in the bandgap circuit of the present embodiment. Here, the resistors R2' and R3' of FIG. 16 illustrate the same resistors as the resistors R2' and R3' of FIG. 12.

Further, the resistors RTRIM2A, RTRIM2B, RTRIM2C, and RTRIM2D in FIG. 16 correspond to the resistors RTRIM2 of FIG. 12, while the switches SWTCA, SWTCB, SWTCC, and SWTCD correspond to the selector SWTC of FIG. 12.

Further, by turning any of SWTCA to SWTCD ON, it is possible to determine the effective resistors R2 and R3 in FIG. 7. Note that, in FIG. 16, the reference notation CSELC expresses the control signals of the switches SWTCA to SWTCD. Further, the numerals added to R2', R3', RTRIM2A, RTRIM2B, RTRIM2C, and RTRIM2D indicate examples of the resistance values (ohms).

In the bandgap circuit of the fourth embodiment as well, in the same way as the first embodiment of FIG. 7, the potential difference across the two ends of R3 becomes ΔVBE, so ΔVBE is amplified to (R2/R3) times and the result added to VBE1 to generate the bandgap voltage VBGR. That is, VBGR, in the same way as explained in relation to the first embodiment, is expressed by the above-mentioned formula (16).

$$VBGR=VBE1+\Delta VBE(R2/R3) \qquad \text{formula (16)}$$

In this regard, if using the selector SWTC like in FIG. 16, R2/R3 becomes variable. For example, if selecting SWTCA (turning it ON), R2/R3 becomes 298 kohms/68 kohm=4.3824. Further, if selecting SWTCB, R2/R3 becomes 300 kohms/66 kohms=4.5455.

Furthermore, if selecting SWTCC, R2/R3 becomes 302 kohm/64 kohms=4.7188. Further, if selecting SWTCC, R2/R3 becomes 304 kiohms/6 kohms=4.9032.

Therefore, if normalizing the value using the R2/R2 when selecting SWTCA as "1", if selecting SWTCA, the normalized R2/R3 becomes the "1". Further, if selecting SWTCB, the normalized R2/R3 becomes 1.037.

Furthermore, if selecting SWTCC, the normalized R2/R3 becomes 1.077. Further, if selecting SWTCC, the normalized R2/R3 becomes 1.119. That is, in the case of this example, it becomes possible to change R2/R3 in 3.7% increments.

Here, if trying to obtain a resolution of 4 bits by just SWTC for example, the number of switches becomes 16. On the other hand, if changing the number of PNP transistors by the above-mentioned control signal CAREA so as to, in the same way as the case of changing the area of Q2, obtain a 4-bit resolution by just this, the number of switches becomes 16 sets or 15 sets.

As opposed to this, as illustrated in FIG. 12, for example, by adjustment 2 bits at a time by CAREA and SWTC, the number of switches forming the SWTC becomes four. The number of switches used for making the area of Q2 variable becomes three sets.

That is, it is learned that even if totaling the switches of the two, it is possible to cut the total number of switches compared with the case of obtaining a resolution of 4 bits by one of CAREA or SWTC. This is a layered effect obtained by combining different methods of adjustment of CAREA and SWTC.

In this way, if, like in the fourth embodiment illustrated in FIG. 12, combining the technique of making the area of Q2 variable and the technique of making R2/R3 variable by SWTC, it is possible to reduce the total number of switches compared with when making the area of Q2 variable or making just R2/R3 variable to realize a resolution of about 4 bits and possible to expect the effect of cutting the leakage current of the switches, improving the precision, and lowering the power.

Figure 13:
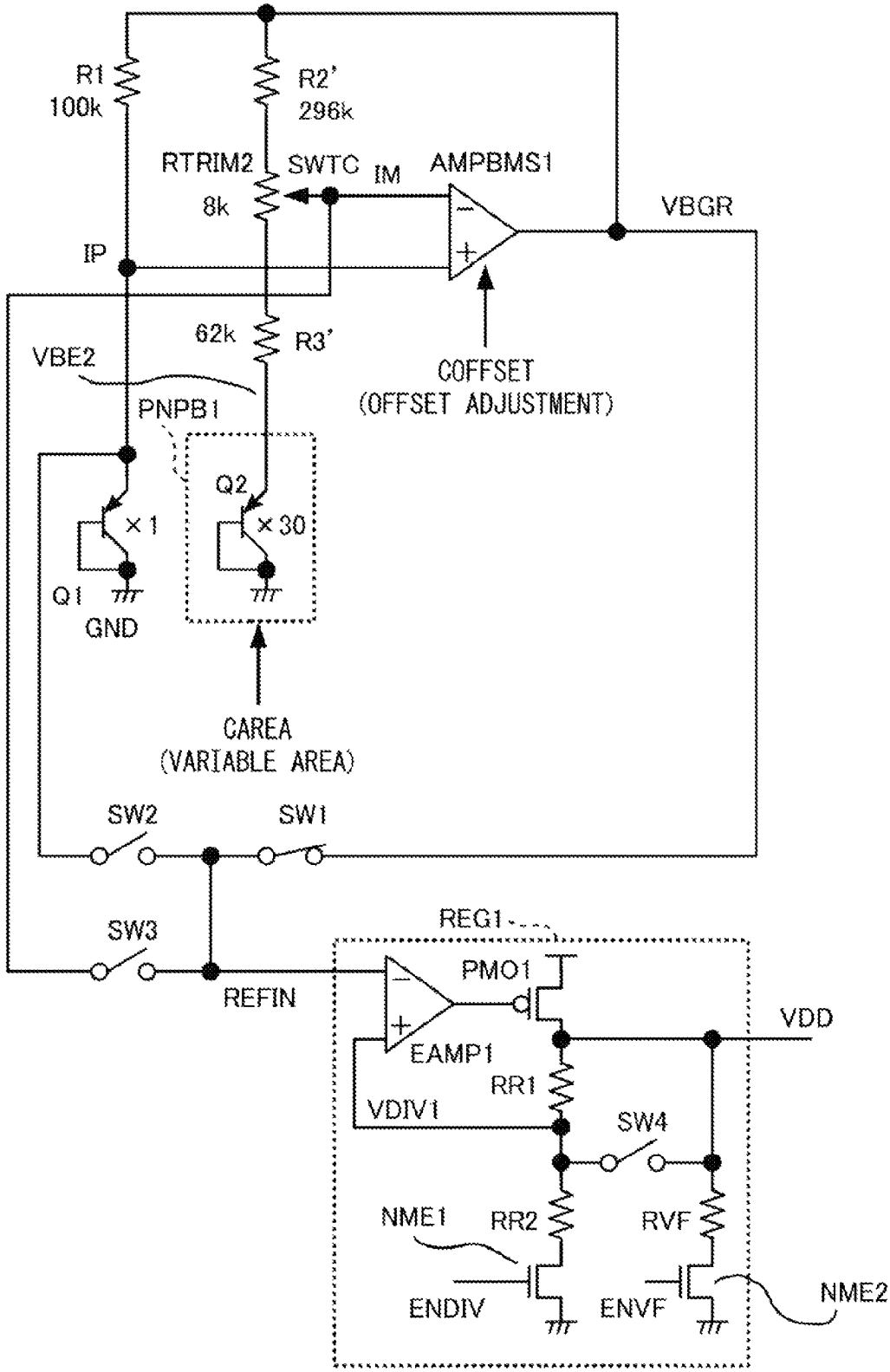
FIG. 13 is a circuit diagram illustrating a bandgap circuit of a fifth embodiment.

FIG. 13 is a circuit diagram illustrating a bandgap circuit of the fifth embodiment. In the same way as the second embodiment of FIG. 10 compared with the first embodiment of FIG. 7, this corresponds to a circuit in which AMPBM1 and AMPBS1 in the fourth embodiment of FIG. 12 are illustrated as AMPBMS1 and the offset adjustment signal is made COFFSET.

That is, in the fourth embodiment of FIG. 12, the auxiliary amplifier AMPBS1 was used as the offset adjustment circuit, but in the fifth embodiment, so long as the offset may be adjusted by the amplifier (main amplifier), the potentials of IP and IM to VDD may be taken out by control of SW1, SW2, SW3, SW4, ENVF, and ENDIV and the offset voltage of AMPBMS1 may be adjusted to zero by COFFSET.

Furthermore, this is similar to the fourth embodiment of FIG. 12 in the point of adjusting the offset voltage of the amplifier AMPBMS1 to zero, then adjusting the area of Q2 by CAREA and, further, adjusting the ratio of R2 and R3 by SWTC to further correct the potential of VBGR.

In this way, in the bandgap circuit of the fifth embodiment, by adjusting the offset voltage of AMPBMNS1 by COFFSET and combining the switching operations of SW1 to SW4, REG1, PNPB1, etc. like in the second embodiment of FIG. 10, it is possible to obtain effects similar to the first embodiment of FIG. 7. Furthermore, it becomes possible to adjust the offset of the amplifier to zero, then adjust the area of the PNP transistor Q2 and the R2/R3 ratio like in the fourth embodiment of FIG. 12 to thereby further correct the potential of VBGR.

Figure 14:
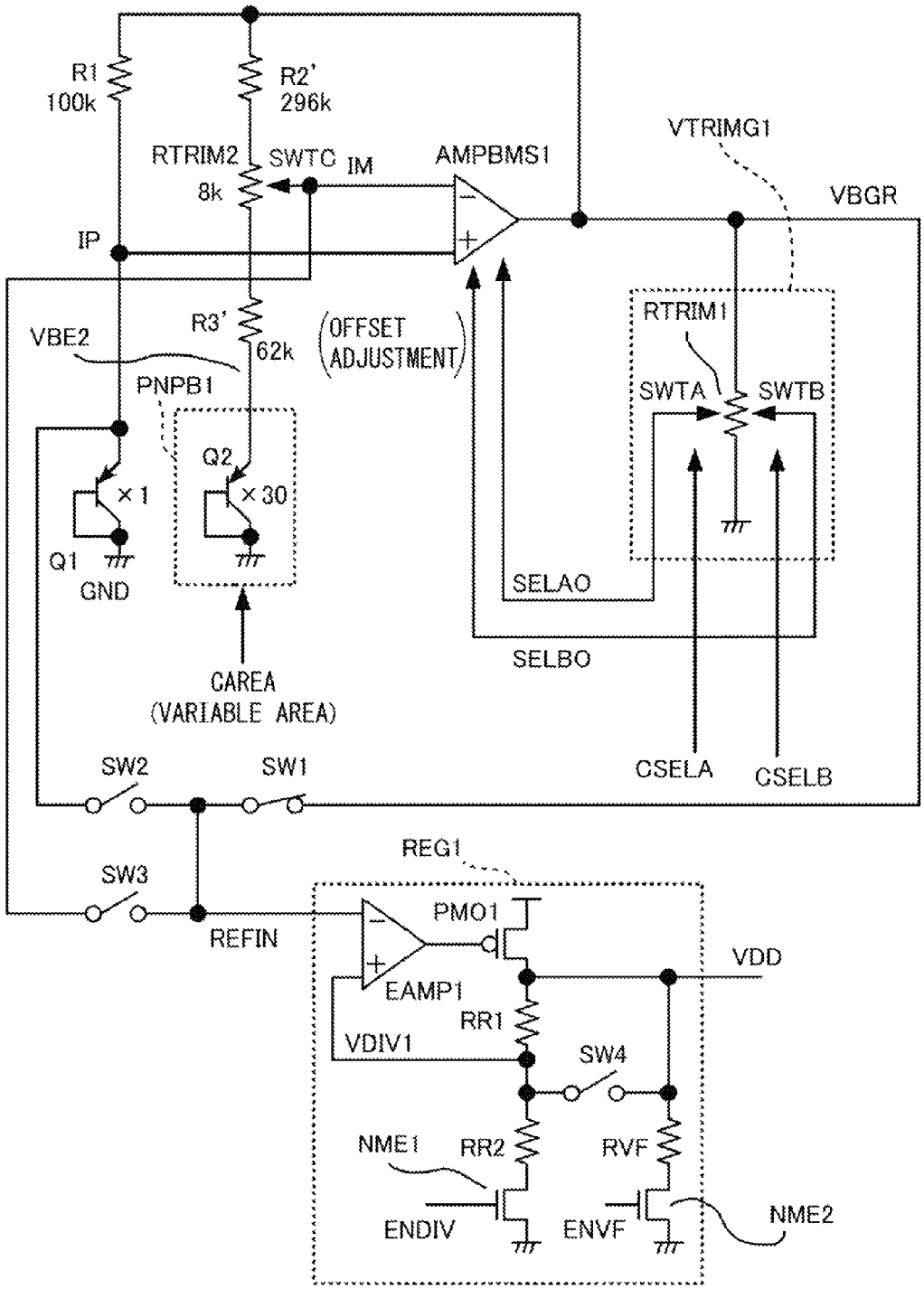
FIG. 14 is a circuit diagram illustrating a bandgap circuit of a sixth embodiment.

FIG. 14 is a circuit diagram illustrating a bandgap circuit of a sixth embodiment. In the above-mentioned FIG. 13, the offset adjustment signal of the amplifier AMPBMS1 was illustrated as COFFSET, but in the sixth embodiment of FIG. 14, the offset adjustment signal is illustrated as SELAO and SELBO. The relationship of the sixth embodiment of this FIG. 14 and the fifth embodiment of the FIG. 13 corresponds to the relationship of the third embodiment of FIG. 11 and the second embodiment of FIG. 10.

That is, in the same way as the fifth embodiment, in the bandgap circuit of the sixth embodiment, the offset voltage of the amplifier AMPBMS1 is adjusted by the potentials SELAO and SELBO obtained by dividing VBGR by the resistor RTRIM1.

Therefore, as the amplifier AMPBMS1 illustrated in FIG. 14, for example, the case where both the main amplifier AMPBM1 and the auxiliary amplifier AMPBS1 in FIG. 7 are included may be considered. However, the amplifier AMPBMS1 in the bandgap circuit of the sixth embodiment illustrated in FIG. 14 is not limited to one including the AMPBM1 and AMPBS1 of FIG. 7. It may also be configured in various ways enabling offset adjustment by SELAO and SELBO. Furthermore, various offset adjustment mechanisms may be used in the amplifier AMPBMS1. It is sufficient that the offset voltage of AMPBMS1 may be adjusted by the potentials obtained by dividing VBGR.

Furthermore, in the bandgap circuit of the sixth embodiment, it is possible to adjust the offset of the amplifier to zero, then adjust the area of the PNP transistor Q2 and the R2/R3 ratio so as to further correct the potential of VBGR. Effects similar to the fourth embodiment of FIG. 12 and the fifth embodiment of FIG. 13 may be anticipated. That is, by reducing the total number of the switches, the effects may be anticipated of reduction of the leakage current of the switches, improvement of the precision, and reduction of the power.

Figure 15:
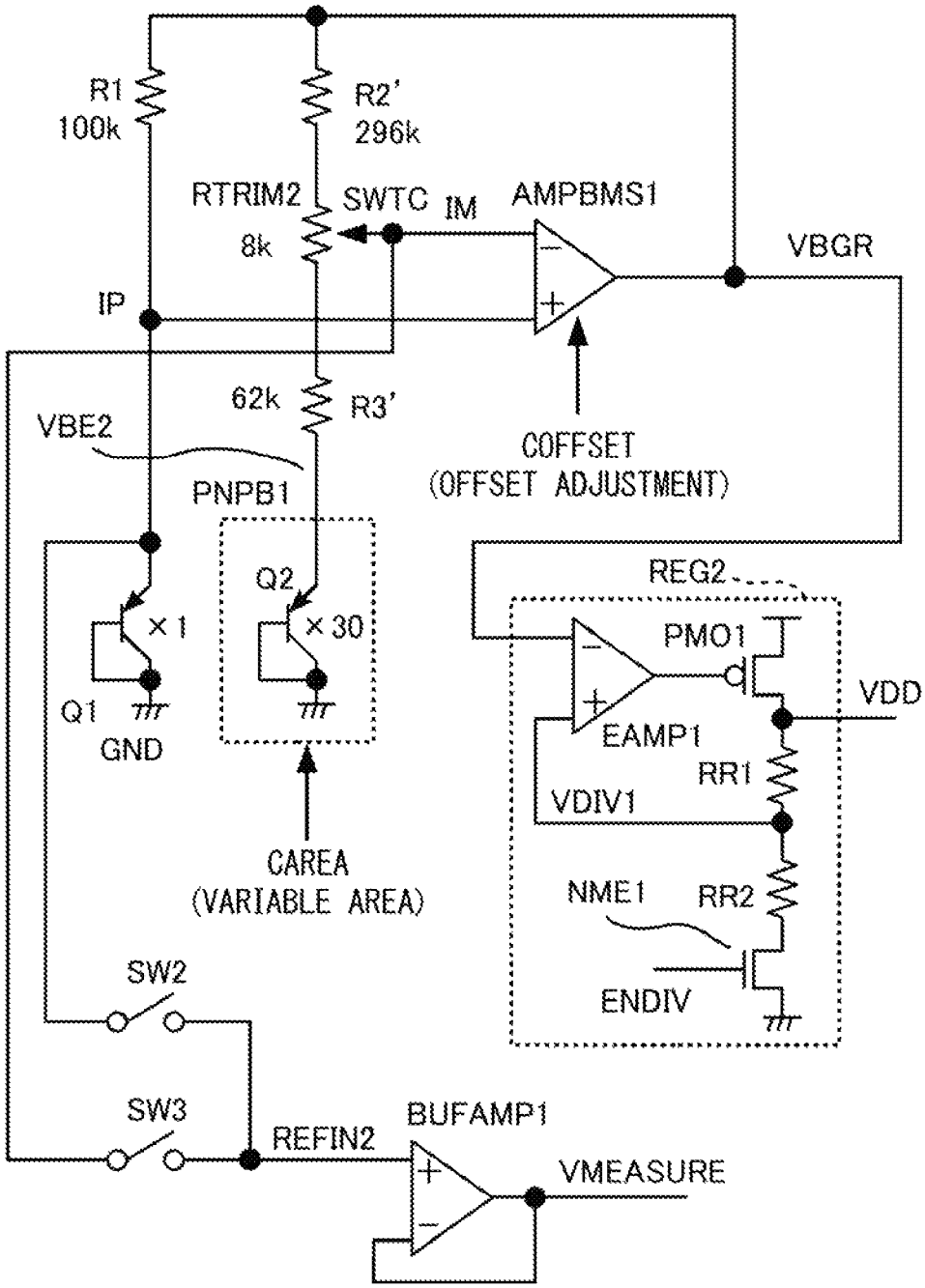
FIG. 15 is a circuit diagram illustrating a bandgap circuit of a seventh embodiment.

FIG. 15 is a circuit diagram which illustrates a bandgap circuit of a seventh embodiment. A clear from a comparison of FIG. 15 and the above-mentioned FIG. 13, in the seventh embodiment, instead of the regulator REG1, a dedicated buffer amplifier BUFAMP1 (coupling node potential takeout circuit) is used to take out the potentials of the nodes IP and IM to the outside.

Further, in the seventh embodiment, the regulator REG2 which outputs the VDD may not include the function of taking out the potentials of IP and IM to the outside, so, for example, the switch SW4 (fourth switch), resistor RVF, and transistor NME2 in the REG1 of the fifth embodiment of FIG. 13 are omitted. That is, the REG2 of the seventh embodiment is made the inherent configuration of a regulator.

In the bandgap circuit of the seventh embodiment, first, in the same way as the above-mentioned fifth embodiment of FIG. 13, the offset voltage of the amplifier (main amplifier) AMPBMS1 itself is adjusted to zero by the offset adjustment signal COFFSET.

Furthermore, the offset voltage of AMPBMS1 is adjusted to zero, then the area of Q2 is adjusted by CAREA and, further, the ratio of R2 and R3 is adjusted by SWTC to further correct the potential of VBGR.

Here, in the bandgap circuit of the seventh embodiment, only SW2 (first switch) and SW3 (second switch) are provided. Further, at the time of ordinary operation, SW1 and SW2 are OFF. When taking out the potential of the IP node, SW2 is turned ON and SW3 is turned OFF. Further, when taking out the potential of the IM node, SW is turned OFF and SW3 is turned ON. Note that, VDD is output from the regulator REG2 without relation to the processing for taking out the potentials of IP and IM to the outside.

Due to this, the plus side input REFIN2 of the BUFAMP1 is coupled to the IP or IM, while the potential is taken out to the outside as the output voltage VMEASURE. Note that, the processing after taking out the potentials of IP and IM to the outside performs similar processing as the case when taking out the potentials of IP and IM to the outside as the output voltage VDD of the regulator REG1. That is, the area of Q2 is adjusted by CAREA, the ratio of R2 and R3 is adjusted by SWTC, and the potential of VBGR is further corrected.

Note that, a configuration like the seventh embodiment where the potentials of IP and IM are taken out to the outside through the BUFAMP1 instead of REG1 may of course be applied to not only the fifth embodiment of FIG. 13, but also the first to fourth and sixth embodiments. Furthermore, as the circuit for taking out the potentials of IP and IM to the outside, various circuits may be used.

Figure 17:
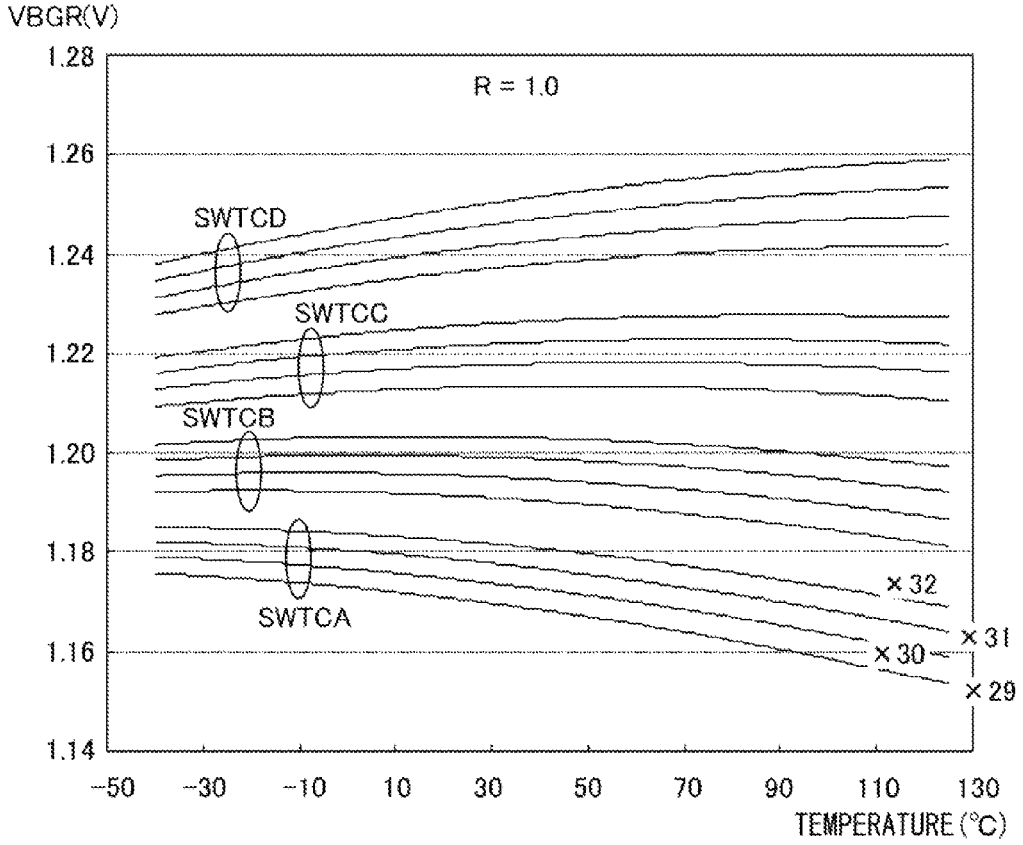
FIG. 17 is a view illustrating the relationship between temperature and an output voltage in a bandgap circuit of the present embodiment (part 1)
Figure 18:
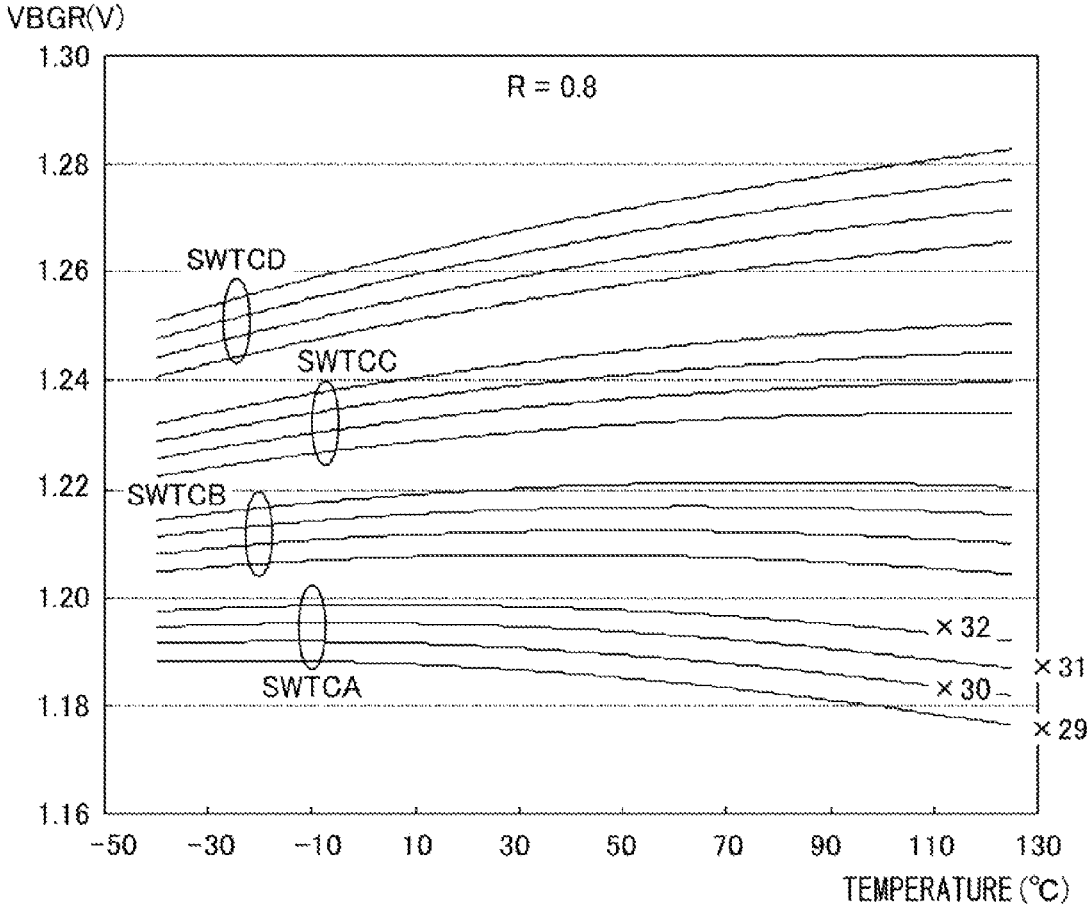
FIG. 18 is a view illustrating the relationship between temperature and an output voltage in a bandgap circuit of the present embodiment (part 2)

FIG. 17 to FIG. 19 are views illustrating the relationship between the temperature and output voltage in a bandgap circuit of the present embodiment. In the fourth embodiment illustrated in FIG. 12, the relationship between the temperature and the bandgap voltage when the offset voltage of the operational amplifier is zero is illustrated.

Here, FIG. 17 illustrates the relationship between the bandgap voltage VBGR and temperature of the fourth embodiment illustrated in FIG. 12 at a typical value (R=1) of the sheet resistance of the resistor. Note that, the abscissa indicates the temperature, while the ordinate indicates the bandgap voltage. Note that, the offset voltage of the operational amplifier is made zero.

In FIG. 17, the characteristic which is indicated by reference notation WTCA illustrates the relationship between the bandgap voltage and the temperature when selecting the switch SWTCA by FIG. 16, further, the characteristic which is indicated by SWTCB illustrates the relationship between the bandgap voltage and the temperature when selecting the switch SWTCB.

Furthermore, the characteristic which is indicated by reference notation WTCC illustrates the relationship between the bandgap voltage and the temperature when selecting the switch SWTCC by FIG. 16, further, the characteristic which is indicated by SWTCD illustrates the relationship between the bandgap voltage and the temperature when selecting the switch SWTCD.

Here, at SWTCA to SWTCD, four VBGR-temperature characteristics are included. These illustrate the VB-temperature characteristics in the case where the areas of the PNP transistor Q2 are 29 times larger, 30 times larger, 31 times larger, and 32 times larger the area in the order, from the bottom, of the suffixes ×29, ×30, ×31, and ×32. That is, FIG. 17 illustrates a total 16 characteristics of the four areas of Q2 and four takeout positions of SWTC.

Note that, the relationships between the characteristic curves and selection of switches of FIG. 18 and FIG. 19 are similar to those of FIG. 17. FIG. 18 illustrates when the sheet resistance of the resistor is 0.8 time the typical value (R=0.8). Further, FIG. 19 illustrates when the sheet resistance of the resistor is 1.2 time the typical value (R=1.2).

As illustrated in FIG. 17 to FIG. 19, it is learned that if making the emitter area of the PNP transistor Q2 29 times the area of Q1 or 30 times, 31 times, or 32 times it, the bandgap voltage rises a little at a time.

Further, it is learned that by changing the switch from SWTCA to SWTCB, SWTCC, and SWTCD, the effective ratio of R2/R3 becomes larger, so the bandgap voltage becomes larger.

Here, in FIG. 17, it is learned that the relationship between the temperature and the VBGR becomes close to a flat characteristic, for example, when selecting SWTCB and making Q2 32 times the area or when selecting SWTCC and making Q2 29 times the area.

Further, in FIG. 18, for example, it is learned that when selecting SWTCB and making Q2 30 times the area, a lower voltage is selected. Furthermore, in FIG. 19, for example, it is learned that when selecting SWTCC and making Q2 31 times the area, a higher voltage is selected.

That is, as illustrated in FIG. 18, if the value of the sheet resistance of the resistor is small (R=0.8), the value of the current flowing through the circuit becomes larger, so even if the characteristics of the PNP transistors are the same, the value of VBE becomes larger. For this reason, to generate the optimum VBGR, a lower potential is set to be output.

Conversely, as illustrated in FIG. 19, if the value of the sheet resistance of the resistor is large (R=1.2), the value of the current flowing through the circuit becomes smaller, so even if the characteristics of the PNP transistors are the same, the value of VBE becomes smaller. For this reason, to generate the optimum VBGR, a higher potential is set to be output.

In this way, as illustrated in the fourth to seventh embodiments explained by FIG. 12 to FIG. 15, by combining a unit for making an area of Q2 variable and a unit for adjusting a ratio of R2/R3, the absolute value of the bandgap voltage and the temperature dependency may be finely adjusted as will be understood from FIG. 17 to FIG. 19.

Furthermore, by combining the method of adjusting to zero the offset value of the operational amplifier according to the embodiments which are explained with reference to FIG. 7 and FIG. 10 to FIG. 15, it is possible to adjust the offset voltage of the amplifier, then finely adjust the potential of VBGR.

Figure 20:
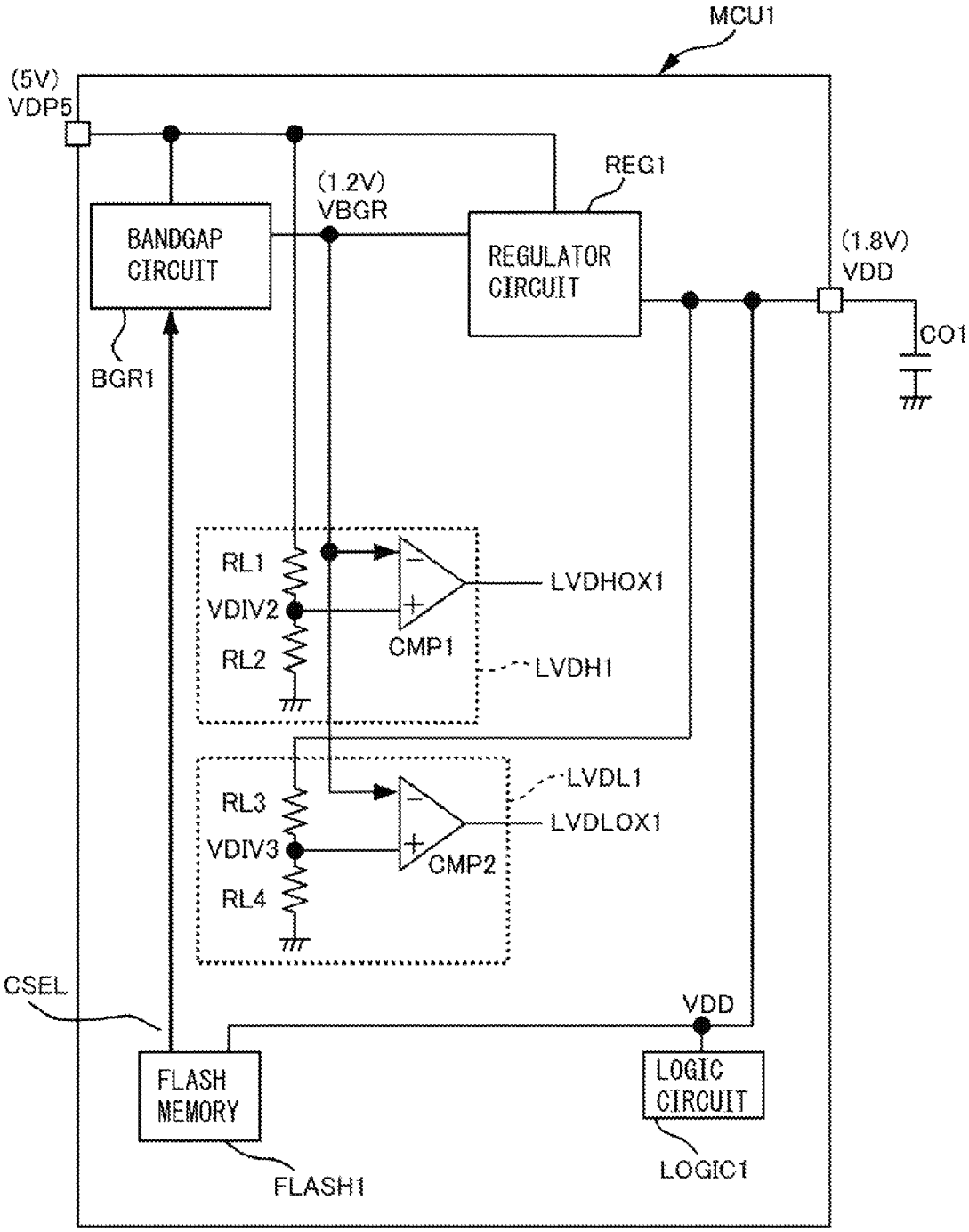
FIG. 20 is a circuit diagram illustrating an example of a microcontroller mounting the bandgap circuit of the present embodiment.

FIG. 20 is a block diagram illustrating one example of a microcontroller mounting a bandgap circuit of the present embodiment and illustrates an example of a low voltage detection circuit utilizing a bandgap circuit of the present embodiment.

In FIG. 20, reference notation BGR1 indicates a bandgap circuit, VDP5 indicates, for example, a 5V plus power source, GND indicates a 0V potential, REG1 indicates a regulator circuit, and, further, LVDH1 indicates a low voltage detection circuit for monitoring the voltage of the 5V power source. Here, the regulator circuit in FIG. 20 corresponds to the regulator circuit REG1 in the first to sixth embodiments explained with reference to FIG. 7 and FIG. 10 to FIG. 14.

Further, reference notation VDD indicates, for example, a 1.8V power source voltage generated at the regulator circuit, LVDL1 indicates a low voltage detection circuit for monitoring the potential of VDD, LOGIC1 indicates a logic circuit which operates using VDD as the power source, and, further, MCU1 indicates a microcontroller.

Further, reference notation CO1 indicates a VDD stabilization capacitor, RL1 and RL2 indicate resistors forming a voltage division circuit for dividing the voltage of VDP5, VDIV2 indicate divided outputs obtained by voltage division by the RL1 and RL2, and, further, RL3 and RL4 indicate resistors forming a voltage division circuit for dividing the voltage of VDD.

Furthermore, VDIV3 indicates a divided output obtained by voltage division by the RL3 and the RL4, CMP1 and CMP2 indicate comparator circuits, LVDHOX1 indicates an output of LVDH1, LVDLOX1 indicates an output of the LVDL1, and, further, FLASH1 indicates a flash memory. Further, CSEL indicates setting data for offset adjustment which is read from the flash memory.

Note that, unless specifically indicated to the contrary, device names starting with "R" indicate resistors, device names starting with "PM" indicate pMOS transistors, and, further, device names starting with "C" indicate capacitors.

FIG. 20 illustrates an example of the circuit in the case of using the 1.2V bandgap output VBGR illustrated in FIG. 7 and FIG. 12 to form the low voltage detection circuit. By making the BGR1 of FIG. 20 the circuit of FIG. 7 and FIG. 20, it is possible to use a high precision bandgap voltage. As a result, the precision of the output voltage of the regulator circuit rises and the precision of the detection voltage of the low voltage detection circuit may be raised.

Below, the operations of the different parts of the circuit will be briefly explained. The regulator circuit REG1 supplies the logic circuit LOGIC1 inside of the microcontroller MCU1 with, for example, a 1.8V power source voltage. Note that, CO1 acts as a capacitor provided outside of the chip for stabilization of the potential of VDD. If the precision of the potential of the VBGR is improved, the precision of the output potential VDD of the regulator circuit is also improved.

The LVDL1 of FIG. 20 acts as a low voltage detection circuit for monitoring the power source voltage of the VDD. RL3 and RL4 divide the potential of VDD. The divided voltage is compared with the reference voltage VBGR to detect if VDD is lower or higher than the given voltage.

When, due to some sort of situation, the potential of the VDD becomes smaller than a prescribed value, this is detected and, for example, this is often used for an interrupt or reset.

Specifically, for example, if designing RL3 and RL4 to 1:3, the potential of the VDIV3 becomes ¾ of the VDD, so by making the VBGR the reference potential and determining the level of the potential of the VDIV3, it is possible to determine if the VDD is higher or lower than 1.6V.

That is, for example, when the potential of the VDIV3 is lower than VBGR, LVDLOX1 becomes "L". This is used as a signal meaning that VDD is lower than 1.6V. If the precision of the potential of the VBGR is improved, the precision of the potential which is judged at LVDLOX1 is also improved.

The LVDH1 of FIG. 20 acts as a low voltage detection circuit for monitoring the voltage of the 5V power source VDP5. For example, when mounting an AD conversion circuit which preferably operates by a 3.6V or more power source voltage and monitoring a power source voltage of a 5V power source by an LVDH1 for this purpose, sometimes a circuit such as the LVDH1 is used.

The RL1 and RL2 are used to divide the potential of the VDP5, the divided voltage is compared with the reference voltage VBGR, and it is detected if the VDP5 is lower than or higher than a given voltage. When, due to some sort of situation, the potential of the VDP5 becomes smaller than a prescribed value, this is detected and, for example, an interrupt or reset becomes possible.

Specifically, for example, if designing RL1 and RL2 as 2:1, the potential of VDIV2 becomes ⅓ of the potential of VDP5, so by deeming VBGR as the reference potential and determining the high/low level of the potential of VDIV2, it is possible to learn if VDP5 is higher than or lower than 3.6V.

That is, for example, when the potential of the VDIV2 is lower than VBGR, LVDLOX1 becomes "L". This is used as a signal meaning that VDP5 is lower than 3.6V. Note that, when judging if the potential of VDP5 is higher or lower than 3.6V, it is often desirable for the reference voltage for judging 3.6V that the precision of the reference voltage be high.

Here, for example, 5% of 3V becomes 150 mV and 5% of 4V becomes 200 mV. When the absolute value of the voltage to be judged is large, if the error of the reference voltage is large, there is a possibility that the absolute value of the error will become so large that it may not be allowed.

The precision of the voltage division of the voltage division circuits RL1 and RL2 is assumed to be sufficiently good (this may actually be assumed in many cases). At this time, the precision of judgment of the voltage of VDP5 is mainly determined by the precision of the reference voltage.

When dividing the potential of VDP5 into ⅓ and judging the potential of VDP5 compared with VBGR, for example, when the error of VBGR is 1.2V±5%, that is, 1.2V±60 mV, the precision in the case of judging 3.6V becomes 3.6V±5%, that is, 3.6V±180 mV.

Due to this reason, in the low voltage detection circuit, by adopting the configuration such as illustrated in FIG. 20, the effect is obtained that the precision of the low voltage detection circuit may be improved.

To use the BGR circuit (bandgap circuit) of FIG. 1 to judge, for example, a 3.6V voltage, the range of detection of 3.6V actually becomes 3.6V−180 mV to 3.6V+180 mV. Furthermore, for example, it is possible to reliably make the operation of the AD conversion circuit stop at 3.42V. Further, the voltage at which the AD circuit may be reliably used becomes a voltage higher than 3.78V.

Assume that the error of the BGR circuit of the first embodiment of FIG. 12 explained above is 1.2V±2%. If trying to control the operation and stopping of the AD conversion circuit by LDVH1 by the configuration of the circuit of FIG. 20, the precision of LVDH1 is improved, so, for example, to judge a voltage of 3.6V, the range of detection of 3.6V actually becomes 3.6V−72 mV to 3.6V+72 mV. That is, for example, it is to reliably make the operation of the AD conversion circuit stop at 3.528V. The voltage at which the AD circuit may be reliably used becomes a voltage higher than 3.672V.

That is, when the precision of the low voltage detection circuit is poor and using the BGR circuit of FIG. 1 to judge the voltage, even if trying to judge 3.6V, the minimum voltage of judgment becomes 3.42V and the maximum becomes 3.78V. For this reason, when using the AD conversion circuit for control, the AD conversion circuit may operate by the minimum voltage 3.42V. Further, if the power source voltage does not exceed 3.78V, use may not be possible.

By using the VBGR of the fourth embodiment of FIG. 12 and improving the voltage detection precision of LVDH1, for example, the minimum voltage for judgment becomes 3.528V and, further, the maximum becomes 3.672V. For this reason, there is no longer a need to design the AD conversion circuit to operate at a lower voltage than used and, further, use becomes possible from a voltage closer to the minimum operable voltage.

Above, as explained, for example, it is possible to use the VBGR of FIG. 7 and FIG. 20 to improve the voltage detection precision of a low voltage detection circuit which detects a high potential. Due to this, the effect is also obtained that it is possible to ease demands on the operating voltage for a circuit to be controlled.

Figure 21:
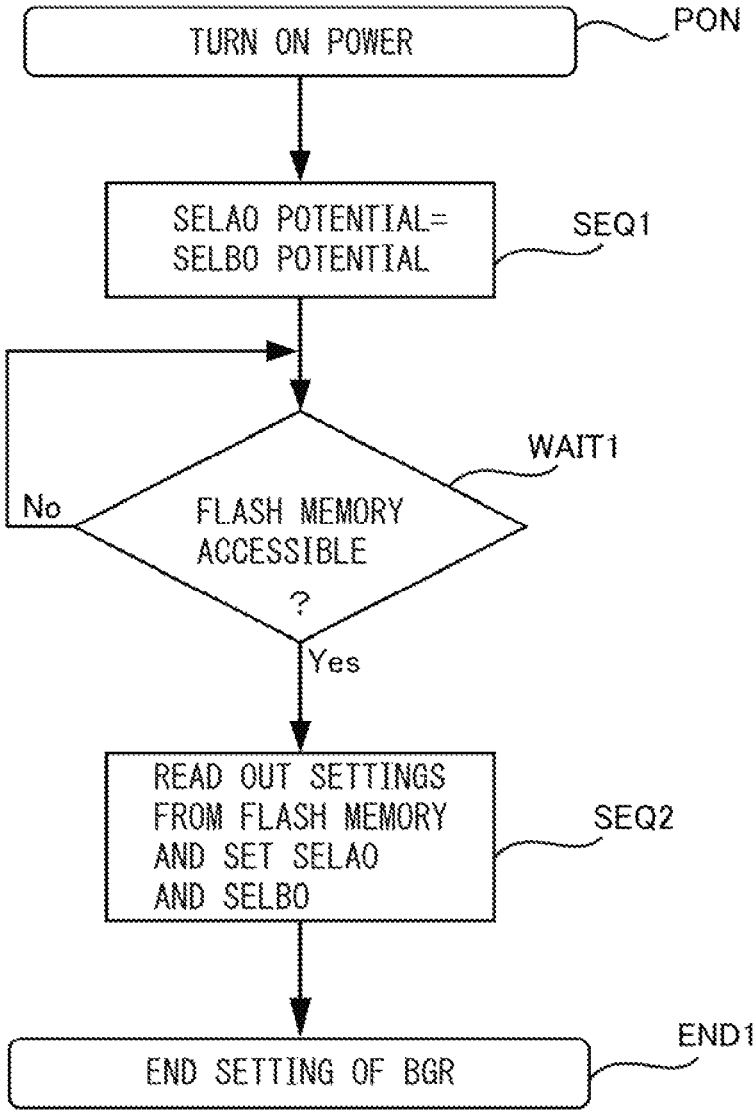
FIG. 21 is a view for explaining the operation at the time of turning on the power of a bandgap circuit of the present embodiment.

FIG. 21 is a view for explaining the operation at the time of turning on the power source of the bandgap circuit of the present embodiment. First, referring to FIG. 7, as explained, for example, the flash memory stores the settings of the gate voltages SELAO and SELBO for canceling out the offset voltage of the main amplifier.

Further, as illustrated in FIG. 21, right after the power source is turned on (PON of FIG. 21), it is possible to set the potentials of SELAO and SELBO at certain fixed values (SEQ1 of FIG. 21), generate the potential of VBGR, and operate the regulator circuit so as to generate the internal voltage VDD.

After that, starting from the time when the flash memory may be read out from (WAIT1 of FIG. 21), the gate voltage setting for canceling out the stored offset voltage from the flash memory is read out. Note that, when the flash memory may not be read out from, it is waited until the flash memory may be read out from.

Further, by canceling out the offset voltage of the main amplifier by the settings of SELAO and SELBO (SEQ2 of FIG. 21), it is possible to improve the precision of VBGR (END1 of FIG. 21). By using this VBGR, it is possible to improve the voltage precision of the low voltage detection circuit and regulator circuit.

Here, in the microcontroller of FIG. 20 explained above, reference notation CSEL indicates the setting data for offset adjustment which is read out from the flash memory. Further, by configuring the microcontroller like in FIG. 20, for example, it is possible to realize a regulator and low voltage detection circuit which makes use of the advantageous and improvement of precision explained with reference to FIG. 7 and FIG. 12 and, furthermore, possible to realize control of the bandgap circuit at the time of turning on the power source.

Figure 22:
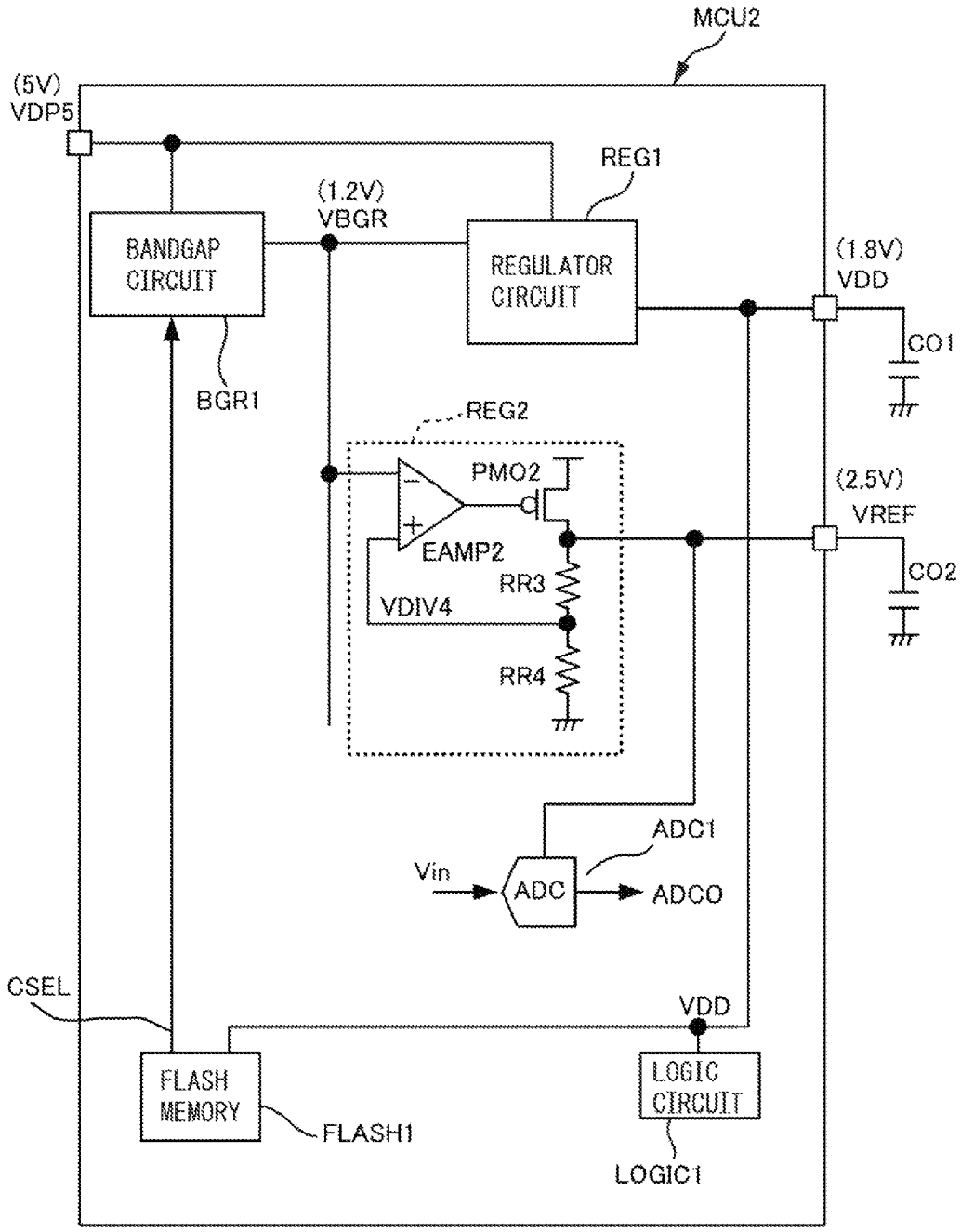
FIG. 22 is a circuit diagram illustrating another example of a microcontroller mounting the bandgap circuit of the present embodiment.

FIG. 22 is a block diagram which illustrates another example of a microcontroller which mounts a bandgap circuit of the present embodiment.

In FIG. 22, reference notation BGR1 indicates a bandgap circuit, VDP5, for example, indicates a 5V+ power source, GND indicates a potential of 0V, and REG1 indicates a regulator circuit which generates VDD. Here, the regulator circuit in FIG. 22 corresponds to the regulator circuit REG1 in the first to sixth embodiments explained with reference to FIG. 7 and FIG. 10 to FIG. 14.

Further, reference notation VDD indicates a, for example, 1.8V power source voltage generated by the regulator circuit, LOGIC1 indicates a logic circuit which operates using VDD as a power source, MCU2 indicates a microcontroller, and CO1 indicates a stabilization capacitor of VDD.

Further, reference notation VREF indicates a reference voltage of the AD conversion circuit, REG2 indicates a regulator circuit generating a VREF potential, CO2 indicates a stabilization capacitor of VREF, and RR3 and RR4 indicate resistors forming a voltage division circuit dividing the voltage of the VREF.

Further, reference notation VDIV4 indicates divided output obtained by dividing the voltage by RR3 and RR4, PMO2 indicates the PMOS output transistor of REG2, EAMP2 indicates an error amplifier, ADC1 indicates an AD conversion circuit, and Vin indicates an analog input signals.

Furthermore, reference notation ADCO indicates the results of AD conversion, FLASH1 indicates a flash memory, and CSEL indicates setting data for offset adjustment which is read out from the flash memory.

Note that, unless otherwise indicated, device names starting with "R" indicate resistors, device names starting with "PM" indicate pMOS transistors, while device names starting with "C" indicate capacitors.

FIG. 22 illustrates an example of a circuit, for example, which utilizes a 1.2V bandgap output VBGR illustrated in FIG. 7 and FIG. 12 to generate, for example, a 2.5V reference voltage VREF by the regulator REG2.

By making the BGR1 of FIG. 22, for example, the circuit of FIG. 7 and FIG. 20, it is possible to use a high precision bandgap voltage. As a result, the precision of the output voltage of the regulator REG2 rises and the precision of the reference voltage VREF of the AD conversion circuit may be raised.

Note that, the microcontroller of the FIG. 20 and FIG. 22 explained above is a simple example of the microcontroller which carries a bandgap circuit of the present embodiment. The microcontroller may be configured in various ways. Furthermore, application of the bandgap circuit of the present embodiment is not limited to a microcontroller. Application to various circuits is of course possible.

Figure 23:
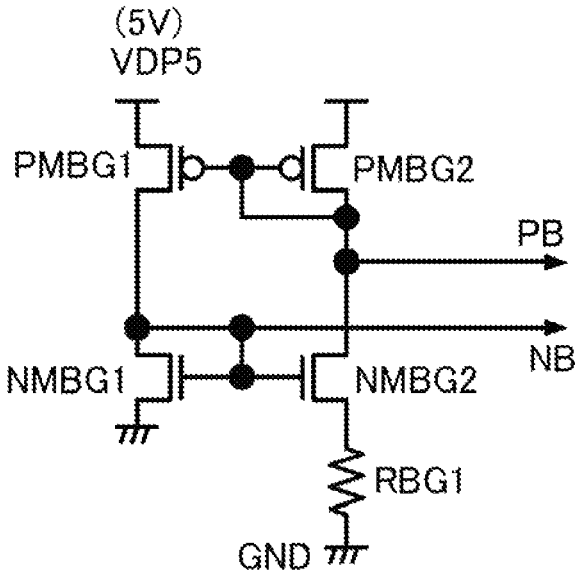
FIG. 23 is a circuit diagram illustrating an example of a bias voltage generation circuit which is applied to a bandgap circuit of the present embodiment.

FIG. 23 is a circuit diagram which illustrates an example of a bias voltage generation circuit used for a bandgap circuit of the present embodiment. In FIG. 23, the reference notations PMBG1 and PMBG2 indicate pMOS transistors, NMBG1 and NMBG2 indicate nMOS transistors, and, further, RBG1 indicates a resistor.

The circuit of FIG. 23 functions as a bias potential generation circuit which generates bias potentials NB and PB. Note that, the bias potential generation circuit of FIG. 23 is just one example. It is also possible to use bias potential generation circuits of various other circuit configurations of course.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a illustrating of the superiority and inferiority of the invention. Although the embodiments of the present invention have been described in detail, it should be understood that the various changes, substitutions, and alterations could be made hereto without departing from the spirit and scope of the invention.

What is claimed is:

1. A reference voltage circuit comprising:

a first amplifier including first and second input terminals, coupled to a first power source line and a second power source line, configured to output a reference voltage;

a first load device and a first PN junction device coupled in series between a reference voltage line to which the reference voltage is applied and the second power source line;

second and third load devices and a second PN junction device coupled in series between the reference voltage line and the second power source line, the first input terminal being coupled to a first coupling node which connects the first load device and the first PN junction device, the second input terminal being coupled to a second coupling node which connects the second load device and the third load device;

an offset voltage reduction circuit configured to reduce an offset voltage between the first and second input terminals at the first amplifier;

a coupling node potential takeout circuit configured to take out potentials of the first and second coupling nodes; and an area adjustment circuit configured to adjust an area of the second PN junction device in accordance with the potentials of the first and second coupling nodes which are taken out by the coupling node potential takeout circuit.

2. The reference voltage circuit as claimed in claim 1, wherein the reference voltage circuit further comprises:

a first switch coupled to the first coupling node and the coupling node potential takeout circuit; and a second switch coupled to the second coupling node and the coupling node potential takeout circuit, wherein the first and second switches are controlled to take out the potentials of the first and second connection nods as outputs of the coupling node potential takeout circuit.

3. The reference voltage circuit as claimed in claim 2, wherein the coupling node potential takeout circuit takes out the potentials of the first and second coupling nodes through a regulator circuit which outputs an internal voltage.

4. The reference voltage circuit as claimed in claim 3, wherein the reference voltage circuit further comprises a third switch coupled to the output of the first amplifier and the regulator circuit;

the regulator circuit includes a first circuit configured to output the internal voltage, a second circuit configured to take out the potentials of the first and second coupling nodes as output voltages of the regulator circuit, and a fourth switch configured to switch operations of the first and second circuits;

the regulator circuit turns off the first, second, and fourth switches and turns on the third switch when generating the internal voltage;

the regulator circuit turns on the first and fourth switches and turns off the second and third switches when taking out the potential of the first coupling node as an output voltage of the regulator circuit; and the regulator circuit turns on the second and fourth switches and turns off the first and third switches when taking out the potential of the second coupling node as the output voltage of the regulator circuit.

5. The reference voltage circuit as claimed in claim 2, wherein the coupling node potential takeout circuit is a buffer amplifier and takes out the potentials of the first and second coupling nodes as an output voltage of the buffer amplifier.

6. The reference voltage circuit as claimed in claim 5, wherein the buffer amplifier turns on the first switch and turns off the second switch when taking out the potential of the first coupling node as the output voltage of the buffer amplifier; and the buffer amplifier turns off the first switch and turns on the second switch when taking out the potential of the second coupling node as the output voltage of the buffer amplifier.

7. The reference voltage circuit as claimed in claim 1, wherein the reference voltage circuit further comprises:

a resistance ratio control circuit configured to control a ratio of the resistance values of the second load device and the third load device in accordance with the potentials of the first and second coupling nodes which are taken out from the coupling node potential takeout circuit.

8. The reference voltage circuit as claimed in claim 7, wherein the offset voltage reduction circuit is built in the first amplifier and reduces the offset voltage between the first and second input terminals by an offset adjustment signal.

9. The reference voltage circuit as claimed in claim 7, wherein the offset voltage reduction circuit comprises:

a second amplifier coupled to the first amplifier, including third and fourth input terminals, and coupled to the first power source line and the second power source line; and an offset adjustment voltage generation circuit configured to generate a voltage which is input to the third and fourth input terminals of the second amplifier and configured to reduce the offset voltage between the first and second input terminals of the first amplifier through the second amplifier.

10. The reference voltage circuit as claimed in claim 9, wherein the second amplifier includes a single-stage third amplification circuit; and a current output of the third amplification circuit is added to two current outputs of an input differential circuit of the first amplification circuit.

11. The reference voltage circuit as claimed in claim 9, wherein the offset adjustment voltage generation circuit generates a voltage which is input to the first and fourth input terminals so as to cancel the offset voltage between the first and second input terminals.

12. The reference voltage circuit as claimed in claim 1, wherein the first amplifier comprises as a two-stage configuration first amplification circuit and second amplification circuit; and the first amplification circuit includes an input differential circuit and a fourth load device which converts two current outputs of the input differential circuit to a voltage value.

13. The reference voltage circuit as claimed in claim 12, wherein the first PN junction device is a first PNP transistor, the second PN junction device is a second PNP transistor, the first load device is a first resistor, the second load device is a second resistor, the third load device is a third resistor, and the fourth load device is a load transistor; and the first PNP transistor and the second PNP transistor are biased to different current densities.

14. A semiconductor integrated circuit comprising:

a reference voltage circuit;

a low voltage detection circuit which monitors a power source voltage of a first power source line;

an internal circuit; and a regulator circuit which generates an internal voltage for operating the internal circuit from a first power source voltage of the first power source line which is supplied from the outside, wherein the reference voltage circuit comprises:

a first amplifier including first and second input terminals, coupled to a first power source line and a second power source line, configured to output a reference voltage;

a first load device and a first PN junction device coupled in series between a reference voltage line to which the reference voltage is applied and the second power source line;

second and third load devices and a second PN junction device coupled in series between the reference voltage line and the second power source line, the first input terminal being coupled to a first coupling node which connects the first load device and the first PN junction device, the second input terminal being coupled to a second coupling node which connects the second load device and the third load device;

an offset voltage reduction circuit configured to reduce an offset voltage between the first and second input terminals at the first amplifier;

a coupling node potential takeout circuit configured to take out potentials of the first and second coupling nodes; and an area adjustment circuit configured to adjust an area of the second PN junction device in accordance with the potentials of the first and second coupling nodes which are taken out by the coupling node potential takeout circuit.

15. The semiconductor integrated circuit as claimed in claim 14, wherein the coupling node potential takeout circuit takes out the potentials of the first and second coupling nodes through a regulator circuit which outputs an internal voltage.

* * * * *